US009745684B2

(12) United States Patent
Lee et al.

(10) Patent No.: US 9,745,684 B2
(45) Date of Patent: Aug. 29, 2017

(54) WASHING MACHINE HAVING BALANCER AND METHOD FOR CONTROLLING THE SAME

(71) Applicant: SAMSUNG ELECTRONICS CO., LTD., Suwon-si (KR)

(72) Inventors: Ji Eun Lee, Seongnam (KR); Yoon Sup Kim, Suwon (KR); Su Ho Jo, Seongnam (KR); Kwan Joo Myoung, Suwon (KR); Awata Hiroshi, Seongnam (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 1035 days.

(21) Appl. No.: 14/015,286

(22) Filed: Aug. 30, 2013

(65) Prior Publication Data

US 2014/0101864 A1 Apr. 17, 2014

(30) Foreign Application Priority Data

Oct. 12, 2012 (KR) ..... 10-2012-0113262

(51) Int. Cl.
*D06F 37/22* (2006.01)
*D06F 33/02* (2006.01)

(52) U.S. Cl.
CPC ..... *D06F 37/225* (2013.01); *D06F 33/02* (2013.01); *D06F 2202/02* (2013.01);
(Continued)

(58) Field of Classification Search
CPC ..... D06F 37/22; D06F 37/225; D06F 2222/00
(Continued)

(56) References Cited

U.S. PATENT DOCUMENTS 5,862,553 A * 1/1999 Haberl ..... D06F 37/225 68/12.06
2012/0084926 A1* 4/2012 Lee ..... D06F 37/225 8/137

(Continued)

FOREIGN PATENT DOCUMENTS

EP 2 441 872 A2 4/2012
JP 03111096 A * 5/1991

(Continued)

OTHER PUBLICATIONS

JP2005021505—Machine Translation, Jan. 2005.*

(Continued)

*Primary Examiner* — Michael Kornakov
*Assistant Examiner* — Marc Lorenzi
(74) *Attorney, Agent, or Firm* — Staas & Halsey LLP

(57) ABSTRACT

A washing machine having a balancer and a control method thereof which achieve correct communication between a controller and a balancing module such that a balancing module is correctly shifted to a target position. The control method of the washing machine includes measuring a first time between position detection time points of the balancing modules during rotation of the rotary tub when the plurality of balancing modules is in a static mode, measuring a second time between position detection time points of the balancing modules during rotation of the rotary tub when any one of the balancing modules is shifted by a predetermined distance through a movement command, and confirming a relationship between a module ID of any one of the balancing modules and a communication ID of the movement command through a relative variation of the second time with respect to the first time.

4 Claims, 28 Drawing Sheets

(52) U.S. Cl.
CPC .... *D06F 2202/04* (2013.01); *D06F 2202/085* (2013.01); *D06F 2204/065* (2013.01); *D06F 2210/00* (2013.01); *D06F 2222/00* (2013.01)

(58) Field of Classification Search
USPC ..... 68/23.2
See application file for complete search history.

(56) References Cited

U.S. PATENT DOCUMENTS

2012/0192362 A1 8/2012 Lee et al.
2012/0278996 A1* 11/2012 Park ..... D06F 33/02 8/137

FOREIGN PATENT DOCUMENTS

JP 2005-21505 1/2005
KR 20060088720 A * 8/2006
KR 10-2011-0010945 2/2011
WO WO 2010/133480 A1 11/2010

OTHER PUBLICATIONS

KR20110010945—Machine Translation, Feb. 2011.*
KR20060088720—Machine Translation, Aug. 2006.*
JPH03111096—Machine Translation, May 1991.*
Cover Sheet of European Patent Application No. EP 2 432 926 A0 corresponding to Reference AG.
Chinese Office Action dated Jul. 25, 2016 in corresponding Chinese Patent Application No. 201310475795.7.
Chinese Office Action dated Jan. 23, 2017 in corresponding Chinese Patent Application No. 201310475795.7.

* cited by examiner

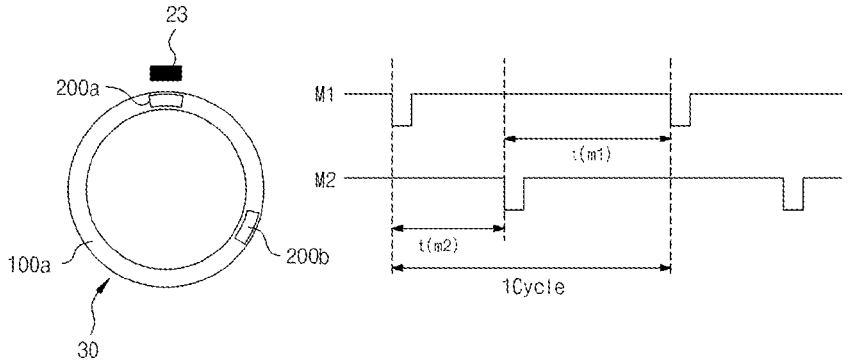
FIG.28B
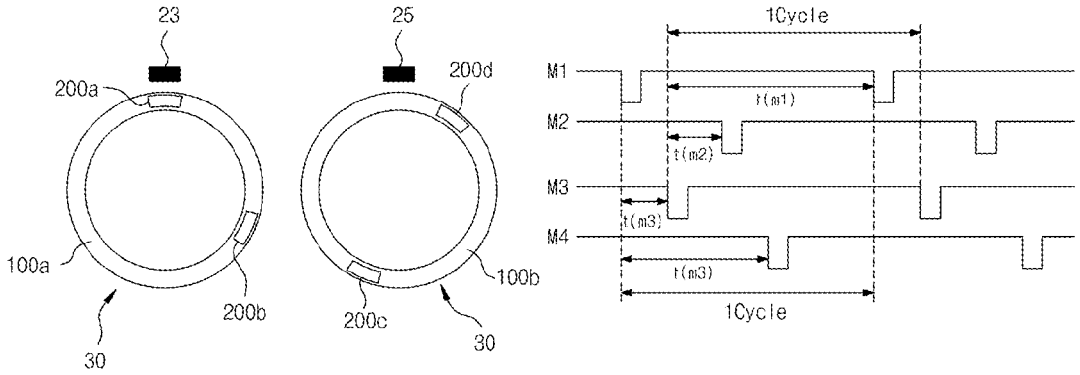

WASHING MACHINE HAVING BALANCER AND METHOD FOR CONTROLLING THE SAME

CROSS-REFERENCE TO RELATED APPLICATIONS

This application claims the priority benefit of Korean Patent Application No. 10-2012-0113262, filed on Oct. 12, 2012 in the Korean Intellectual Property Office, the disclosure of which is incorporated herein by reference.

BACKGROUND

1. Field

The following description relates to a washing machine having a balancer reduce rotary-tub unbalance caused by eccentricity of laundry.

2. Description of the Related Art

Generally, a washing machine is configured to wash or clean laundry in the order of a washing process to separate pollutants from dirty laundry, a rinsing process to rinse the laundry, and a dehydration process to dehydrate the rinsed laundry.

A washing machine includes a tub accommodating water, a rotary tub rotatably connected to the inside of the tub so as to accommodate laundry, and a driver to rotate the rotary tub.

However, the washing machine has a higher rotation speed of a drum in a dehydration process as compared to the washing or rinsing process. When the drum rotates at a high speed, laundry contained in the drum may be unevenly distributed in the drum or may be concentrated on one side of the drum. As a result, the laundry leans to one side of the drum, resulting in the occurrence of unbalance. If unbalance occurs, one-sided force is applied to a rotation axis of the drum, noise and vibration unavoidably increase.

Therefore, an improved washing machine including a balancer has recently been developed to reduce noise and vibration caused by eccentricity of the drum. A balancing module to shift the center of gravity is installed in the balancer, and the balancing module is shifted to the opposite side of the part having eccentricity of the rotary tub, such that the eccentricity caused by the laundry contained in the drum may be removed.

However, assuming that the balancing module of the balancer is disposed at a position similar to a place in which laundry is concentrated, unbalance is not removed but added, such that vibration of the rotary tub is further increased. Therefore, a balancer with a method to accurately shift the balancing module of the balancer to a target position may be desired.

SUMMARY

Therefore, it is an aspect of the present disclosure to provide a washing machine for achieving correct communication between a controller and a balancing module such that the balancing module to be shifted may be correctly shifted to a target position.

Additional aspects of the disclosure will be set forth in part in the description which follows and, in part, will be apparent from the description, or may be learned by practice of the disclosure.

In accordance with an aspect of the present disclosure, a control method of a washing machine which includes a rotary tub accommodating wash water to rotate upon receiving rotational force from a drive source, a balancer mounted to the rotary tub to include a ring-shaped channel in which a plurality of balancing modules to attenuate unbalance generated by rotation of the rotary rub is rotatably disposed, and a position detection sensor configured to detect a position of the plurality of balancing modules includes: measuring a first time between position detection time points of the balancing modules during rotation of the rotary tub when the plurality of balancing modules is in a static mode; measuring a second time between position detection time points of the balancing modules during rotation of the rotary tub when any one of the balancing modules is shifted by a predetermined distance within the channel through a movement command of shifting or moving any one of the balancing modules; and confirming a relationship between a module ID (Identification) of any one of the balancing modules and a communication ID of the movement command through a relative variation of the second time with respect to the first time.

When the relative variation of the second time with respect to the first time is increased or reduced in response to a movement direction of any one of the balancing modules, the relationship between the module ID of any one of the balancing modules and the communication ID of the movement command may be achieved.

The method may further include measuring the first time and the second time by independently shifting each of the balancing modules through a movement command of different communication IDs; and confirming a relationship between the module ID and the communication ID of the movement command of both the balancing modules by comparing the first time with the second time.

The method may further include measuring the first time and the second time by independently shifting each of the remaining balancing modules other than any one of the balancing modules through a movement command of different communication IDs; and confirming a relationship between the module ID and the communication ID of the movement command of the remaining balancing modules other than any one of the balancing modules by comparing the first time with the second time.

Any one of the balancing modules may be assigned the remaining module ID and the remaining communication ID.

The balancer may include a first balancer mounted to a front surface of the rotary tub and a second balancer mounted to a rear surface of the rotary tub, and the relationship between the module ID and the communication ID of the movement command of all the balancing modules may be confirmed through a comparison result of the first time and the second time that are measured for the balancing modules of the first balancer and the second balancer.

In association with each of the first balancer and the second balancer, if a relative variation of the second time with respect to the first time does not occur or the relative variation is less than a predetermined variation, the relationship between the module ID and the communication ID of the movement command of the balancing modules may not be confirmed.

The balancer may include a first balancer mounted to a front surface of the rotary tub and a second balancer mounted to a rear surface of the rotary tub, and the relationship between the module ID and the communication ID of the movement command of all the balancing modules may be measured through a comparison result of the first time and the second time that are measured for the remaining balancing modules other than any one of the first balancer and the second balancer.

Any one of the balancing modules may be assigned the remaining module ID and the remaining communication ID.

In association with each of the first balancer and the second balancer, if a relative variation of the second time with respect to the first time does not occur or the relative variation is less than a predetermined variation, the relationship between the module ID and the communication ID of the movement command of the balancing modules may not be confirmed.

In accordance with another aspect of the present disclosure, a washing machine includes: a rotary tub to accommodate wash water and to rotate upon receiving rotational force from a drive source; a balancer mounted to the rotary tub to include a ring-shaped channel in which a plurality of balancing modules to attenuate unbalance generated by rotation of the rotary rub is rotatably disposed; a position detection sensor configured to detect a position of the plurality of balancing modules; and a controller to measure a first time between position detection time points of the balancing modules during rotation of the rotary tub when the plurality of balancing modules is in a static mode, to measure a second time between position detection time points of the balancing modules during rotation of the rotary tub when any one of the balancing modules is shifted by a predetermined distance within the channel through a movement command of shifting or moving any one of the balancing modules, and to confirm a relationship between a module ID of any one of the balancing modules and a communication ID of the movement command through a relative variation of the second time with respect to the first time.

When the relative variation of the second time with respect to the first time is increased or reduced in response to a movement direction of any one of the balancing modules, the relationship between the module ID of any one of the balancing modules and the communication ID of the movement command may be achieved.

The controller may measure the first time and the second time by independently shifting each of the balancing modules through a movement command of different communication IDs, and may confirm a relationship between the module ID and the communication ID of the movement command of both the balancing modules by comparing the first time with the second time.

The controller may measure the first time and the second time by independently shifting each of the remaining balancing modules other than any one of the balancing modules through a movement command of different communication IDs, and may confirm a relationship between the module ID and the communication ID of the movement command of the remaining balancing modules other than any one of the balancing modules by comparing the first time with the second time.

The controller may assign the remaining module ID and the remaining communication ID to any one of the balancing modules.

The balancer may include a first balancer mounted to a front surface of the rotary tub and a second balancer mounted to a rear surface of the rotary tub, and the controller may confirm the relationship between the module ID and the communication ID of the movement command of all the balancing modules through a comparison result of the first time and the second time that are measured for the balancing modules of the first balancer and the second balancer.

In association with each of the first balancer and the second balancer, if a relative variation of the second time with respect to the first time does not occur or the relative variation is less than a predetermined variation, the controller may not confirm the relationship between the module ID and the communication ID of the movement command of the balancing modules.

The balancer may include a first balancer mounted to a front surface of the rotary tub and a second balancer mounted to a rear surface of the rotary tub, and the controller may confirm the relationship between the module ID and the communication ID of the movement command of all the balancing modules through a comparison result of the first time and the second time that are measured for the remaining balancing modules other than any one of the first balancer and the second balancer.

The controller may assign the remaining module ID and the remaining communication ID to any one of the balancing modules.

In association with each of the first balancer and the second balancer, if a relative variation of the second time with respect to the first time does not occur or the relative variation is less than a predetermined variation, the controller may not confirm the relationship between the module ID and the communication ID of the movement command of the balancing modules.

In accordance with another aspect of the present disclosure, a control method of a washing machine which includes a rotary tub accommodating wash water to rotate upon receiving rotational force from a drive source, a balancer mounted to the rotary tub to include a ring-shaped channel in which a plurality of balancing modules to attenuate unbalance generated by rotation of the rotary rub is rotatably disposed, and a position detection sensor configured to detect a position of the plurality of balancing modules includes: acquiring a position detection signal of any one of the plurality of balancing modules; and recognizing a position of the remaining balancing module from among the plurality of balancing modules on the basis of a position detection signal of any one of the plurality of balancing modules.

The balancer may include a first balancer mounted to a front surface of the rotary tub and a second balancer mounted to a rear surface of the rotary tub, and the controller may use a position detection signal of the balancing module of the second balancer as a reference so as to detect a position of the balancing module of the first balancer, and may use a position detection signal of the balancing module of the first balancer as a reference so as to detect a position of the balancing module of the second balancer.

In accordance with another aspect of the present disclosure, a washing machine includes: a rotary tub accommodating wash water to rotate upon receiving rotational force from a drive source; a balancer mounted to the rotary tub to include a ring-shaped channel in which a plurality of balancing modules to attenuate unbalance generated by rotation of the rotary rub is rotatably disposed; a position detection sensor configured to detect a position of the plurality of balancing modules; and a controller to acquire a position detection signal of any one of the plurality of balancing modules and to recognize a position of the remaining balancing module from among the plurality of balancing modules on the basis of a position detection signal of any one of the plurality of balancing modules.

The balancer may include a first balancer mounted to a front surface of the rotary tub and a second balancer mounted to a rear surface of the rotary tub, and the controller may use a position detection signal of the balancing module of the second balancer as a reference so as to detect a position of the balancing module of the first balancer, and may use a position detection signal of the balancing module of the first balancer as a reference so as to detect a position of the balancing module of the second balancer.

BRIEF DESCRIPTION OF THE DRAWINGS

These and/or other aspects of the disclosure will become apparent and more readily appreciated from the following description of the embodiments, taken in conjunction with the accompanying drawings of which:

FIGS. 28A and 28B are conceptual diagrams illustrating a method for detecting a position of each balancing module for use in the balancer of the washing machine shown in FIG. 26.

DETAILED DESCRIPTION

Figure 1:
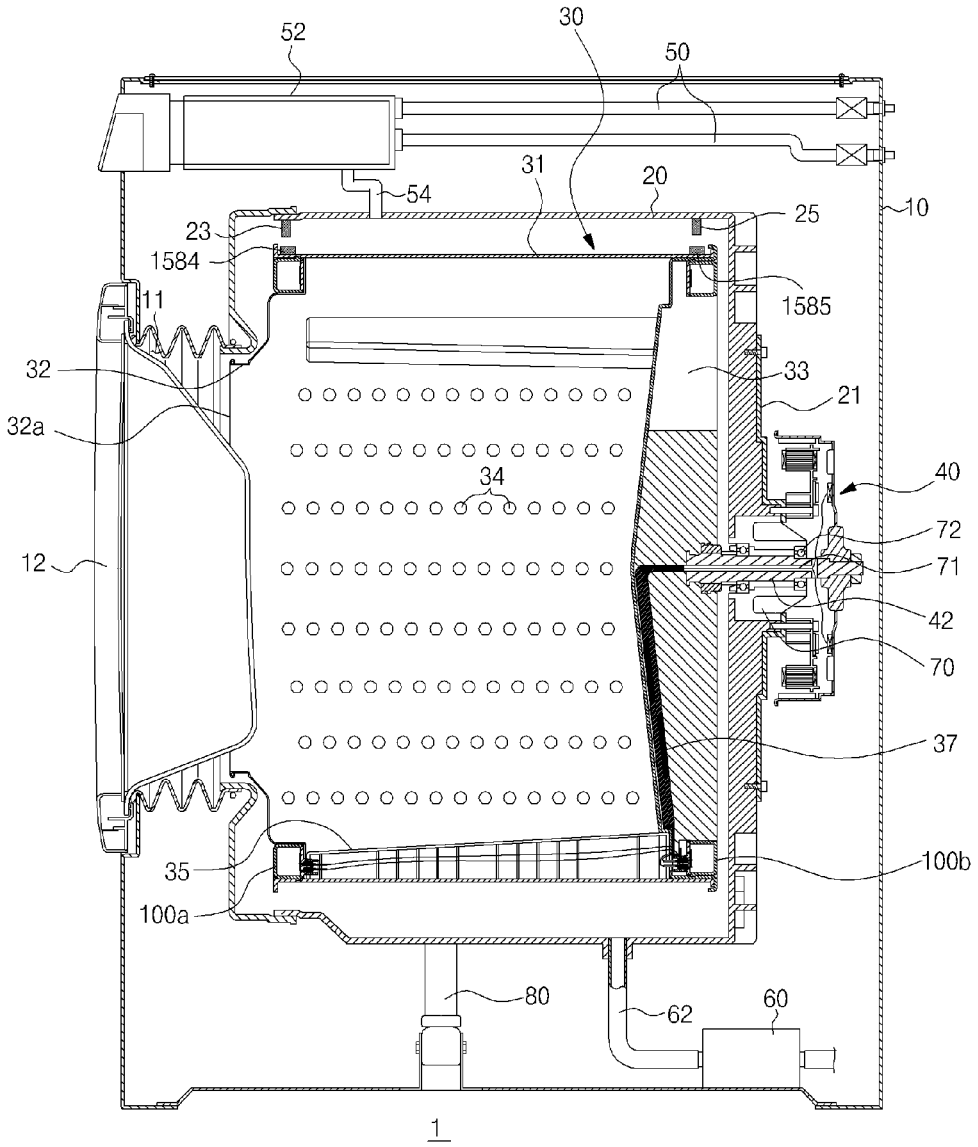
FIG. 1 is a schematic diagram illustrating internal components of a washing machine according to an embodiment of the present disclosure.

Reference will now be made in detail to embodiments of the present disclosure, examples of which are illustrated in the accompanying drawings, wherein like reference numerals refer to like components throughout.

FIG. 1 is a schematic diagram illustrating internal components of a washing machine according to an embodiment of the present disclosure.

Referring to FIG. 1, a washing machine 1 includes a cabinet 10 forming the external appearance thereof, a tub 20 disposed in the cabinet 10, a rotary tub 30 rotatably mounted in the tub 20, and a motor 40 to drive the rotary tub 30. In accordance with some embodiments of the present disclosure, the tub 20 may be integrated with the cabinet 10, or may be omitted as necessary.

An inlet 11 through which laundry is put into the rotary tub 30 is formed through the front surface part of the cabinet 10. The inlet 11 is opened and closed by a door 12 installed on the front surface part of the cabinet 10.

Above the tub 20 is installed a water supply pipe 50 to supply wash water to the tub 20. One side of the water supply pipe 50 is connected to a water supply valve (not shown), and the other side of the water supply pipe 50 is connected to a detergent supply device 52.

The detergent supply device 52 is connected to the tub 20 via a connection pipe 54. Water, supplied through the water supply pipe 50, is supplied into the tub 20 together with a detergent via the detergent supply device 52.

Under the tub 20 are installed a drainage pump 60 and drainage pipe 62 to discharge water in the tub 20 out of the cabinet 10.

The drum 30 includes a cylinder part 31, a front plate 32 disposed at the front portion of the cylinder part 31, and a rear plate 33 disposed at the rear portion of the cylinder part 31. An opening 32*a*, through which laundry is introduced and removed, is formed at the front plate 32.

A plurality of through holes 34 through which wash water flows is formed at the inner circumference of the rotary tub 30. The rotary tub 30 is provided at the inner circumference thereof with a plurality of lifters 35, by which laundry is raised and dropped when the rotary tub 30 is rotated.

The drive shaft 42 is disposed between the rotary tub 30 and the motor 40. One end portion of the drive shaft 42 is connected to the rear plate 33 of the rotary tub 30, and the other end portion of the drive shaft 42 extends to the outside of the rear wall of the tub 20. When the drive shaft 42 is driven by the motor 40, the rotary tub 30 connected to the drive shaft 42 is rotated about the drive shaft 42.

At the rear wall of the tub 20 is installed a bearing housing 70 to rotatably support the drive shaft 42. The bearing housing 70 may be made of, for example, an aluminum alloy. The bearing housing 70 may be inserted into the rear wall of the tub 20 when the tub 20 is injection molded. Between the bearing housing 70 and the drive shaft 42 are installed bearings 72 to smoothly rotate the drive shaft 42.

During a washing cycle, the motor 40 rotates the rotary tub 30 in forward and backward directions at low speed. As a result, laundry in the rotary tub 30 is repeatedly raised and dropped so that contaminants are removed from the laundry.

During a dehydration cycle, the motor 40 rotates the rotary tub 30 in one direction at high speed. As a result, water is separated from laundry by centrifugal force applied to the laundry.

If the laundry is not uniformly distributed in the rotary tub 30 but accumulates at one side when the rotary tub 30 is rotated during the dehydration cycle, rotation of the rotary tub 30 is unstable, resulting in the occurrence of vibration and noise.

For this reason, the washing machine 1 includes balancers 100*a* and 100*b* to stabilize rotation of the rotary tub 30.

Position detection sensors 23 and 25 may be respectively mounted to positions corresponding to the balancers 100*a* and 100*b*. The position detection sensors 23 and 25 may be used to detect the position of the balancing module 200 (See FIG. 7) contained in the balancer 100*a* or 100*b*.

Figure 2:
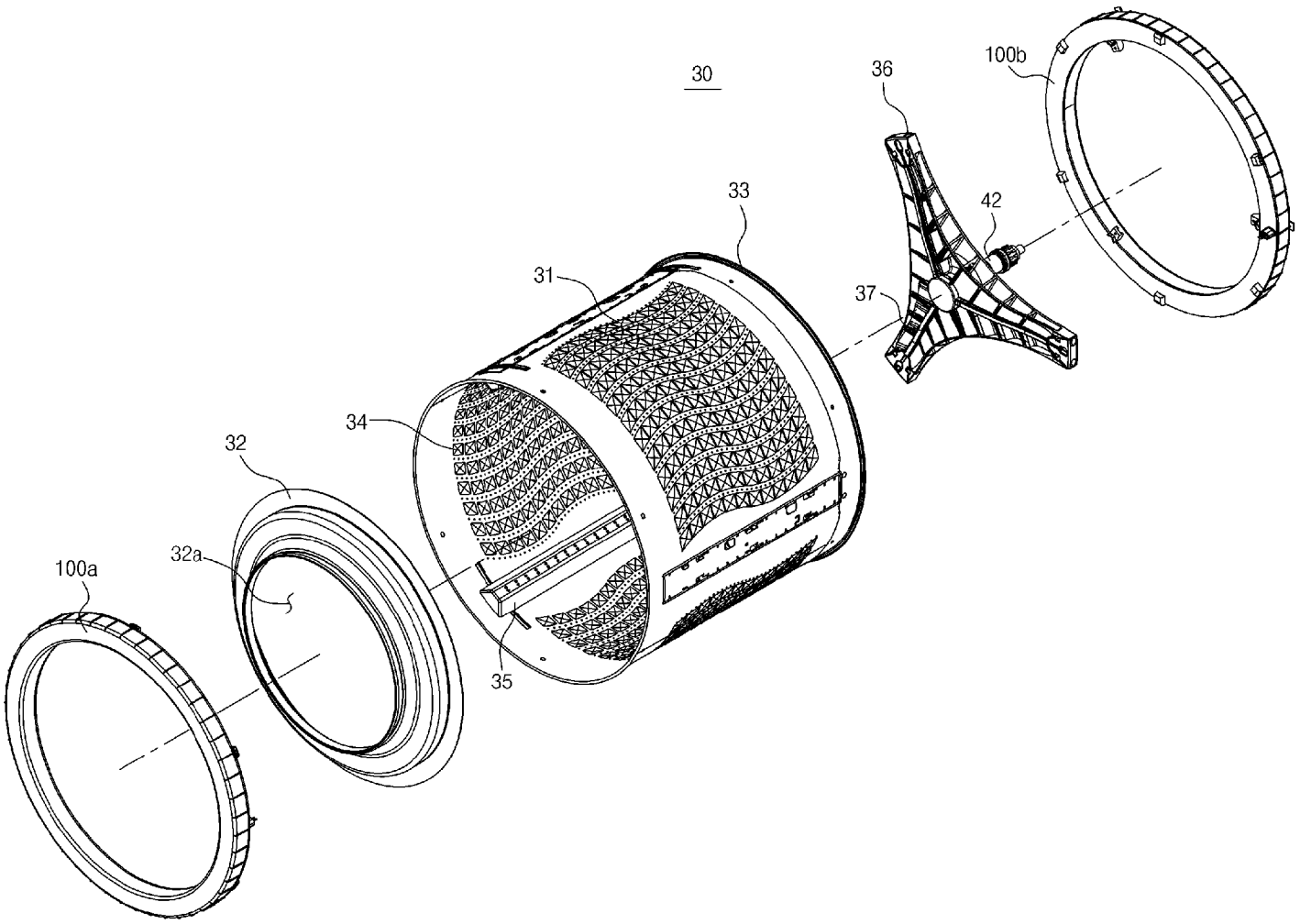
FIG. 2 is an exploded perspective view illustrating a rotary tub of the washing machine shown in FIG. 1.

FIG. 2 is an exploded perspective view showing a rotary tub of the washing machine shown in FIG. 1.

Referring to FIG. 2, the rotary tub 30 includes a cylinder part 31, a front plate 32 disposed at the front portion of the cylinder part 31, and a rear plate 33 disposed at the rear portion of the cylinder part 31. An opening 32*a*, through which laundry is introduced and removed, is formed at the front plate 32.

The front plate 32 is formed to have a step difference so as to protrude forward, and the front balancer 100*a* may be mounted to the stepped part having the step difference.

The rear plate 32 is disposed at a rear portion of the cylinder part 31 so as to cover the rear part of the cylinder part 31. A flange 36 connected to the drive shaft 42 may be coupled to the rear surface of the rear plate 32.

The drive shaft 42 may be coupled to the center part of the flange 36. A guide part 37 through which electric wires 121 and 122 may pass may be formed at the flange part 36, and a detailed description thereof will be described later.

The rear balancer 100*b* may be mounted to the rear surface of the flange part 36.

A lifter 35 may be installed at the inner circumference of the cylinder part 31 of the rotary tub 30.

A plurality of through-holes 34 may be formed in the cylinder part 31 of the rotary tub 30 so that the inner part of the rotary tub 30 may communicate with the outer part thereof.

Figure 3:
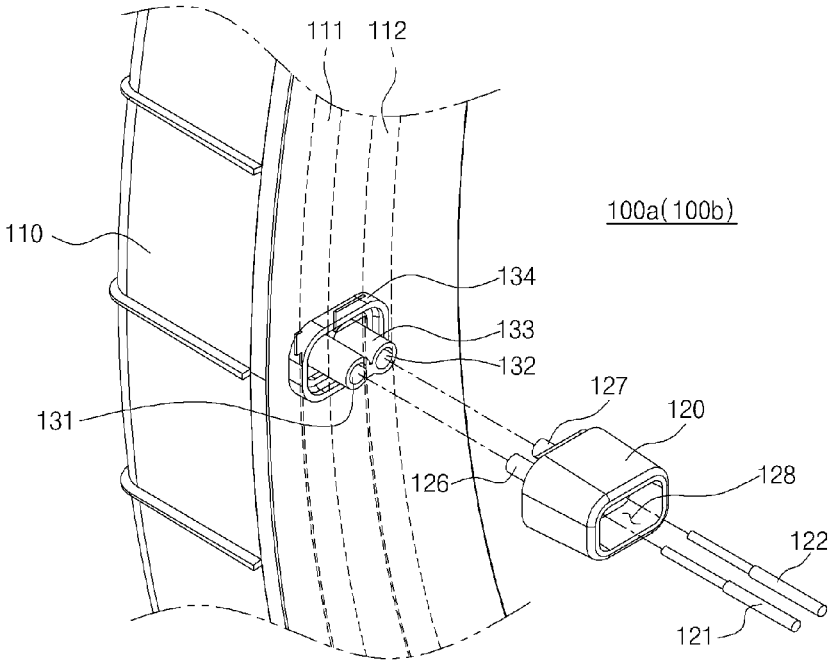
FIG. 3 is a schematic diagram illustrating a balancer according to an embodiment of the present disclosure.

FIG. 3 is a schematic diagram illustrating an electrode of a balancer according to an embodiment of the present disclosure.

Referring to FIG. 3, the balancer housing 110 includes a ring-shaped housing body 115, one side of which is opened, and a housing cover 116 to cover the opened part of the housing body 115.

Electrodes (111, 112) to deliver power generated by an external power source to the balancing modules (200*a*, 200*b*) (See FIG. 7) may be formed at an inner surface of the housing cover 116. The electrodes (111, 112) may be comprised of two electrodes (111, 112) having positive (+) and negative (−) polarities.

The electrodes (111, 112) may be formed along a circumference direction of the ring-shaped housing cover 116. Although the position of the balancing module 200 is changed in response to movement of the balancing module 200 moving in the balancer housing 110, the balancing module 200 is formed to continuously receive power.

In accordance with an embodiment, although the electrodes (111, 112) are formed at the housing cover 116, the electrodes (111, 112) may also be formed at a different surface of the balancer housing 110 without departing from the scope or spirit of the present disclosure.

A connector for electrically coupling the electrodes (111, 112) to an external power source (not shown) may be provided at an outer surface of the housing cover 116 of the balancer housing 110.

Figure 4:
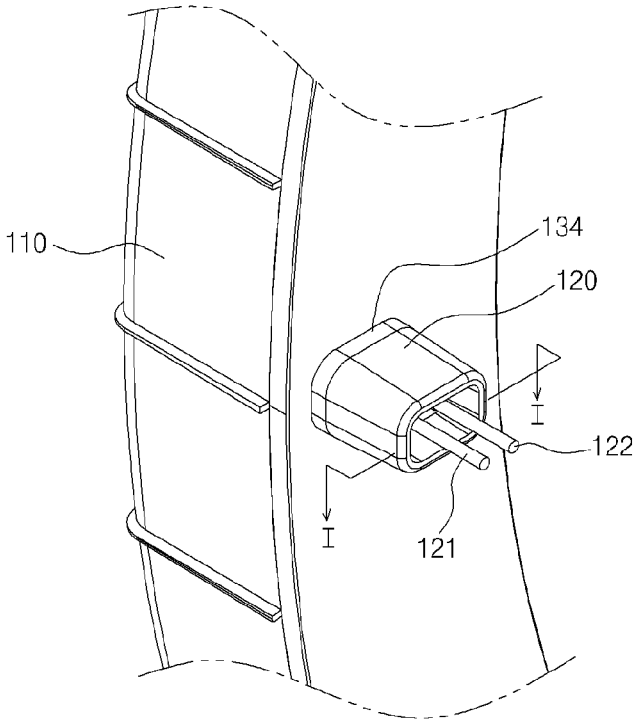
FIGS. 4 and 5 illustrate a balancer housing and a connector shown in FIG. 2, respectively.
Figure 5:
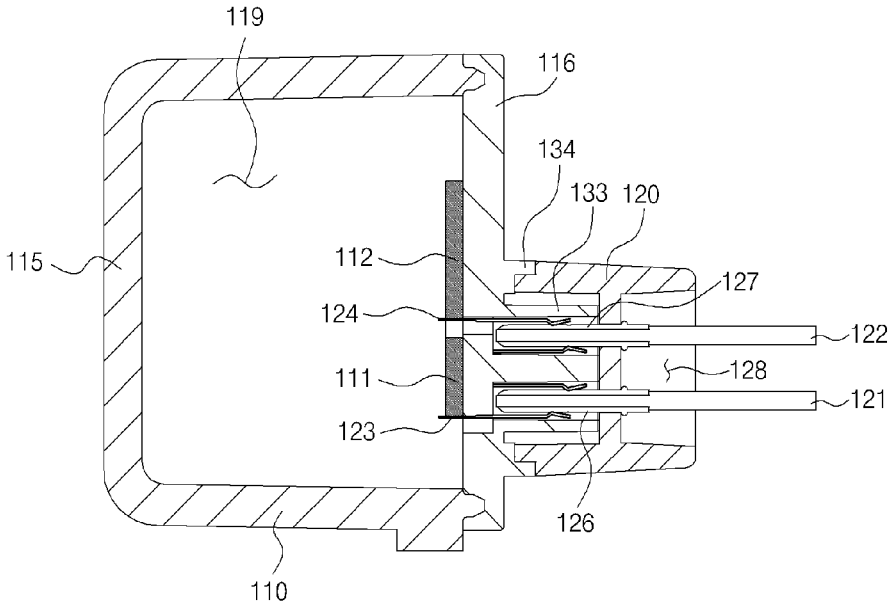
Figure 6:
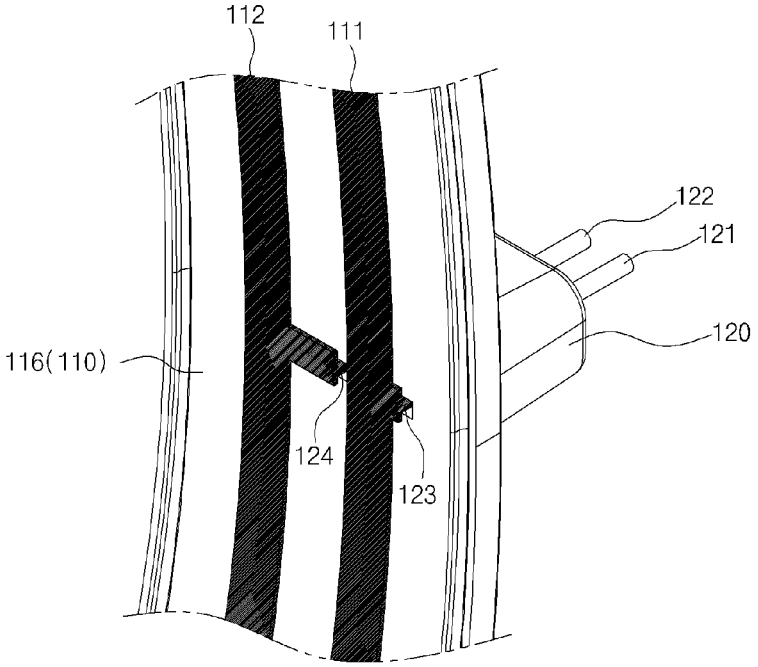
FIG. 6 is a cross-sectional view illustrating the part taken along the line I-I of FIG. 4.

FIGS. 4 and 5 illustrate a balancer housing and a connector shown in FIG. 2, respectively. FIG. 6 is a cross-sectional view illustrating the part taken along the line I-I of FIG. 4.

Referring to FIGS. 4 to 6, a connector may be provided at an outer surface of the housing cover 116 of the balancer housing 110.

The connector may include a plug 120 and a socket 133.

The plug 120 fixes the electric wires (121, 122) to electrically connect external power (not shown) to the balancer housing 110, such that it may be easily coupled to the balancer housing 110. In contrast, the socket 133 is formed in the balancer housing 110 so that it may easily couple the balancer housing 110 to the plug 120.

The plug 120 is formed to have electric wire terminals (126, 127) at which the electric wires (121, 122) may be fixed. The electric wire terminals (126, 127) may fix the electric wires (121, 122), and at the same time may enable the electric wires (121, 122) to be easily inserted into or fixed to the socket 133.

The electric wire terminals (126, 127) may be protruded from one side of the plug 120. As described above, the electric wire electrodes (111, 112) may be comprised of two polarities (+, −), and two electric wires (121, 122) are respectively connected to the electrodes (111, 112), such that two electric wire terminals (126, 127) are needed.

For example, the socket 133 may protrude from the outer surface of the housing cover 116 of the balancer housing 110. In another example, the socket 133 may also be formed at a different lateral surface of the balancer housing 110 without departing from the scope or spirit of the present disclosure.

The socket 133 may include socket holes (131, 132) into which the electric wire terminals (126, 127) may be inserted or fixed. That is, the socket 133 may be formed in the form of a hollow. There are two socket holes (131, 132) corresponding to positive (+) and negative (−) polarities.

The electrode terminals (123, 124) to electrically couple the electrodes (111, 112) to the electric wire terminals (126, 127) connected to the electric wires are contained in the socket holes (131, 132). The electric wire (121 or 122) may be connected to the electrode (111 or 112) corresponding to each polarity through the electrode terminal (123 or 124).

A protrusion 134 protruded from the housing cover 116 of the balancer housing 110 may be formed in the vicinity of the socket 133. The protrusion 134 may have the same size as that of an outer surface of the plug 120. In other words, if the plug 120 is mounted to the socket 133, the outer surface of the protrusion 134 may be naturally connected to the outer surface of the plug 120.

In the case of a connector assembly process, the electric wire terminals (126, 127) are connected to the end parts of the electric wires (121, 122). If the electric wires (121, 122) connected to the electric wire terminals (126, 127) are mounted to the plug 120, and if the plug 120 is mounted to the socket 133, the electric wires (121, 122) may be electrically connected to the electrodes (111, 112).

The outer surface of the balancer housing 110 may be contained in the tub 20 (See FIG. 1) such that it may always contact with wash water. Therefore, if the above-mentioned electric structure is provided, a waterproof structure is needed.

One side of the plug 120 is recessed inward such that it is formed to include a waterproof groove 128 thereon. The waterproof groove 128 is formed at the opposite side of a specific part coupled to the socket 133 of the plug 120.

The electric wires (121, 122) including the electric wire terminals (126, 127) are inserted and fixed to the waterproof groove 128. The waterproof groove 128 is filled with epoxy resin so that waterproofing of the plug 120 is achieved.

There is a need to waterproof the coupling part among the socket 133, the protrusion 134 and the plug 120, and the above-mentioned components 133, 134 and 120 need to be interconnected and also need to be waterproofed. As a result, the protrusion 134 and the plug 120 are interconnected through ultrasonic welding, and at the same time wash water is prevented from flowing in the coupling part between the protrusion 134 and the plug 120.

The above-mentioned method to charge the epoxy resin, the ultrasonic welding method, and another method to achieve a waterproof structure may be contained in the scope or spirit of the present disclosure.

Figure 7:
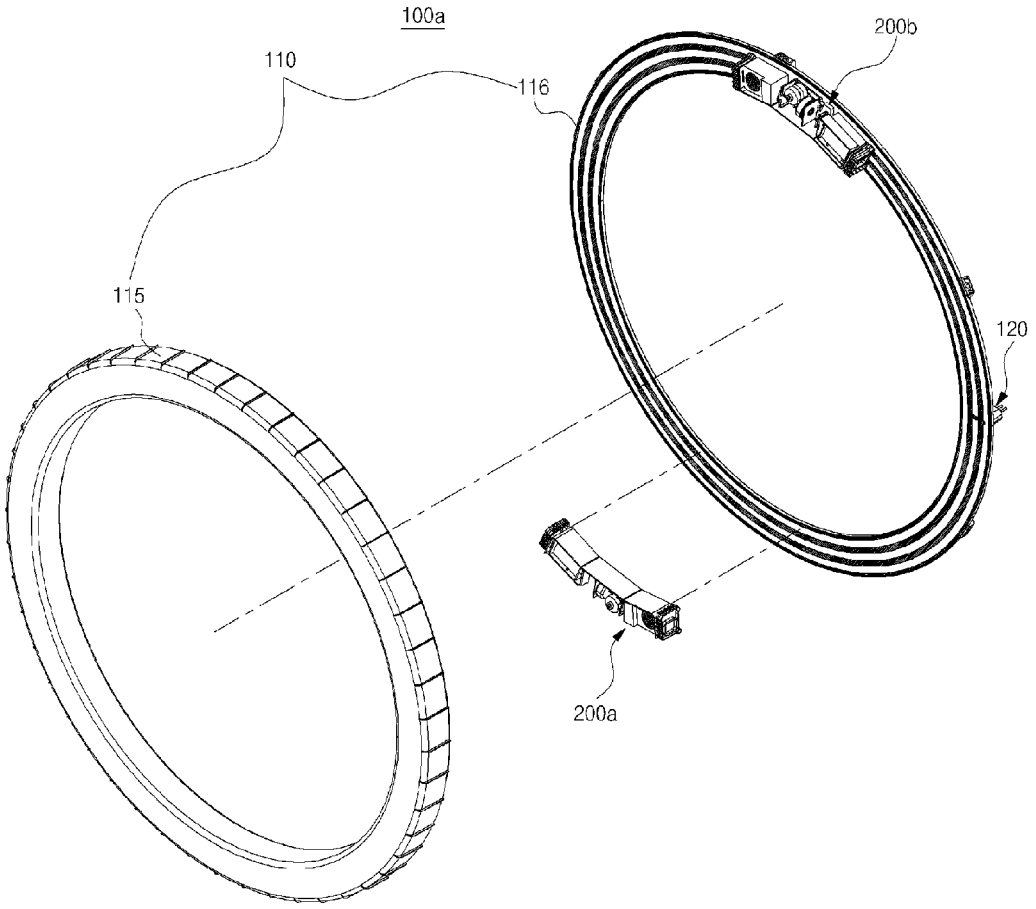
FIG. 7 is a diagram illustrating the balancer housing and an electrode shown in FIG. 2.

FIG. 7 is a diagram illustrating the balancer housing and the electrode shown in FIG. 2.

Referring to FIG. 7, the balancer 100*a* of the washing machine according to embodiments of the present disclosure may include two balancing modules (200*a*, 200*b*). The number of balancing modules (200*a*, 200*b*) may be less than 2 or may also be greater than 2. If a width of each electrode (111, 112) is different from the width of a connector, some parts of the electrodes (111, 112) are protruded so as to contact with the electrode terminals (123, 124).

Figure 8:
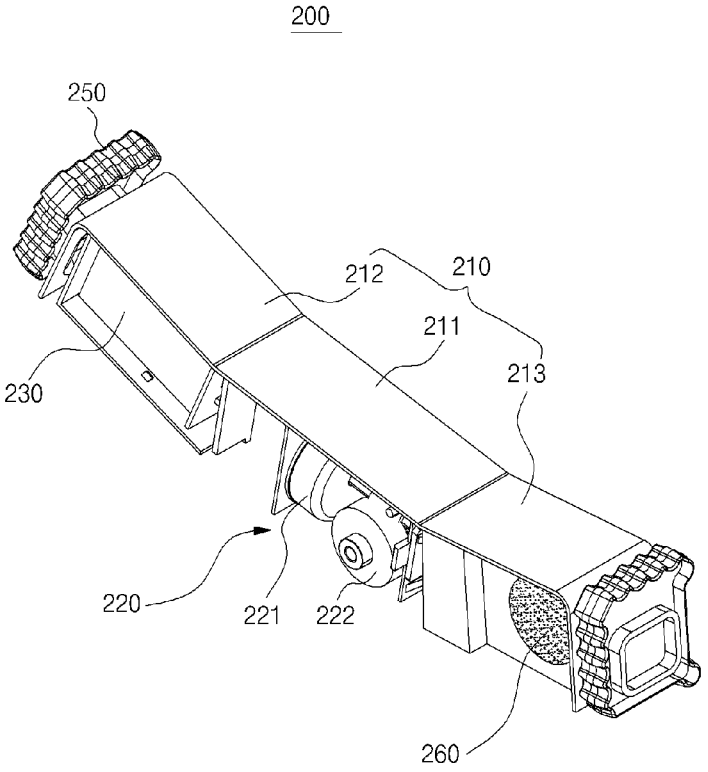
FIG. 8 is a diagram illustrating the balancing module according to an embodiment of the present disclosure.
Figure 9:
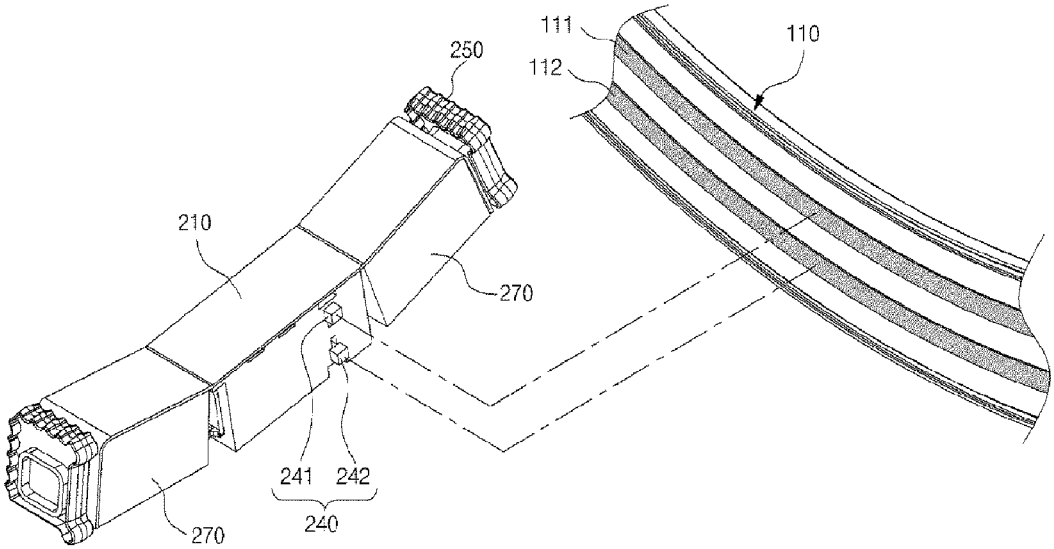
FIG. 9 is a diagram illustrating a balancer module and a balancer housing according to an embodiment of the present disclosure.

FIG. 8 is a diagram illustrating the balancing module according to an embodiment of the present disclosure. FIG. 9 is a diagram illustrating the balancer module and the balancer housing according to an embodiment of the present disclosure.

The balancing module included in the ring-shaped channel 119 (See FIG. 6) formed in the balancer housing 110 (See FIG. 3) will hereinafter be described in detail.

Referring to FIGS. 8 and 9, a basic format of the balancing module 200 may be formed by the main plate 210.

The main plate 210 may include a center plate 211 and lateral plates (212, 213). The lateral plates (212, 213) are curved at a predetermined angle with the center plate 211 at both sides of the center plate 211. The center plate 211 and the lateral plates (212, 213) are formed to have a predetermined angle therebetween, such that the balancing module 200 may be easily shifted within the ring-shaped channel 119 (See FIG. 6). A plurality of mass objects 270 may be mounted to the lateral plates (212, 213). The mass objects 270 are balanced with unbalance generated when laundry contained in the rotary tub 30 (See FIG. 1) leans to one side, such that the degree of unbalance is reduced and the rotary tub 30 may be naturally rotated by reduction of unbalance.

A circuit board 230 may be mounted to the front surface of one of the mass objects 270, and the circuit board 230 may include a variety of components capable of operating a driver 220 to be described later.

A position identification unit 260 may be mounted to one of the mass objects 270. The position identification unit 260 may be any one of a magnetic body including a permanent magnet, a light emitting unit to emit a light, or a reflection plate to reflect the emitted light. As previously stated in FIG. 1, the position detection sensors (23, 25) may be mounted to positions corresponding to the balancers (100*a*, 100*b*). The position detection sensor 23 may be any one of a hall sensor, an infrared sensor, or an optical fiber sensor, for example. If the position detection sensor 23 is the hall sensor, the position identification unit 260 may be a magnetic substance. If the position detection sensor 23 is the infrared sensor, the position identification unit 260 may be the light emitting unit. If the position detection sensor 23 is the optical fiber sensor, the position identification unit 260 may be the reflective plate.

A plurality of bearings 250 may be coupled to the end part of each lateral plate (212 or 213). The bearings 250 enable the balancing module 200 not to collide with the inner lateral surface of the balancer housing 110. In addition, the bearings 250 restrain the balancing module 200 from freely moving in the balancer housing 110, such that the balancing module 200 may be fixed at a correct position where unbalance may be reduced. A detailed description of the bearing 250 will hereinafter be described with reference to FIG. 11.

The driver 220 may be mounted to the center plate 211.

The driver 220 may include a drive wheel 222 to directly move the balancing module 220, and a drive motor 221 to operate the drive wheel 222. A detailed description of the driver 220 will hereinafter be described with reference to FIG. 10.

A plurality of brushes 240 (241 and 242) may be provided at the rear portion of the driver 220. The brush 240 may physically contact with the electrodes (111, 112) of the balancer housing 110, such that the brush 240 may be electrically coupled to the electrodes (111, 112). The brush 240 continuously contacts with the electrodes (111, 112) even when the balancing module 200 moves, such that it enables the balancing module 200 (especially, the driver 220) to be powered on.

Since the electrodes (111, 112) are formed to have two polarities (+, −), two brushes 240 may also be formed in response to the two polarities (+, −). Two brushes 240 may be arranged to contact with two electrodes (111, 112), respectively.

The brush 240 contacts with the electrodes (111, 112) in the rotary tub 30 (See FIG. 1) configured to rotate and vibrate, such that there is a high possibility of damaging the brush 240 and the end part of the brush 240 may be supported by an elastic body.

Figure 10:
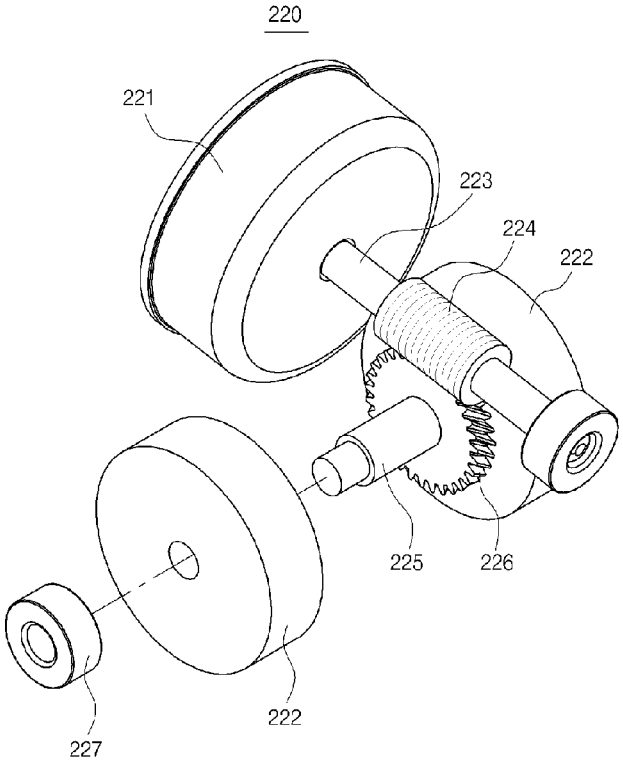
FIG. 10 is a diagram illustrating a driver shown in FIG. 8.

FIG. 10 is a diagram illustrating the driver shown in FIG. 8.

Referring to FIG. 10, the driver may include a drive wheel 222 to move the balancing module 200, and a drive motor 221 to operate the drive wheel 222.

Gears (224, 226) are arranged between the drive motor 221 and the drive wheel 222, such that drive power of the drive motor 221 may be transferred to the drive wheel 222.

In accordance with an embodiment of the present disclosure, the drive motor 221 and the drive wheel 222 are orthogonal to each other, such that a first gear 224 and a second gear 226 are used to transfer the drive power of the drive motor 221 to the drive wheel 222. That is, the first gear 224 or the second gear 226 may be formed in the form of a worm gear.

The first gear 224 may be formed at the drive shaft 223 of the drive motor 221.

The second gear 226 may rotate simultaneously while being meshed with the first gear 224. The rotation shaft 225 is provided at the center part of the second gear 226, and the drive wheel 222 is mounted at both ends of the rotation shaft 225. A wheel cap 227 is provided to secure each wheel 222 to the rotation shaft 225.

The first gear 224 and the second gear 226 may be formed in the form of a helical gear. If a gear located in the vicinity of the wheel is twisted in shape, this gear is referred to as a helical gear.

If the first gear 224 and the second gear 226 are configured in the form of a helical gear, the first and second gears 224 and 226 prevent the drive wheel 222 from freely moving. Therefore, although the driver is not powered on through an external power source (not shown), the balancing module 200 may be fixed at a final position without its own movement.

Figure 11:
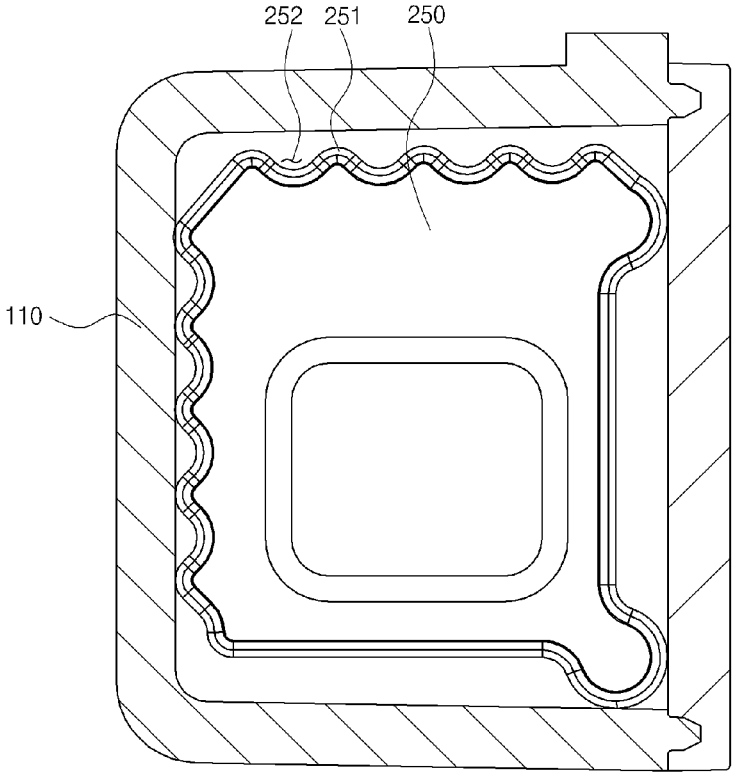
FIG. 11 is a diagram illustrating a balancer housing and a bearing according to an embodiment of the present disclosure.

FIG. 11 is a diagram illustrating the balancer housing and the bearing according to an embodiment of the present disclosure.

Referring to FIG. 11, the bearing 250 is formed to contact the inner surface of the balancer housing 110.

In accordance with this embodiment, the bearing 250 is used as a frictional bearing in a manner that the bearing 250 contacts the inner surface of the balancer housing 110 and movement of the balancing module 200 is fixed within a predetermined range, such that the balancing module 200 does not collide with the inner lateral surface of the balancer housing 110.

A surface of the bearing 250 may include a protruded contact part 251 and a recess part 252 recessed from the contact part 251 to the inside of the bearing 250. That is, a lateral surface of the bearing 250 is curved.

The bearing 250 may prevent a foreign substance present in the balancer housing 110 from passing through between the recess parts 252, or may also prevent the foreign substance from being accumulated in each recess part 252 such that the foreign substance does not hinder movement of the balancing module 200.

In addition, adjustment of the size of the contact part 251 may prevent the balancing module 200 from colliding with a lateral surface of the balancer housing 110, such that the brush 240 may contact with the electrodes (111, 112) simultaneously while maintaining an appropriate distance with the electrodes (111, 112).

Figure 12:
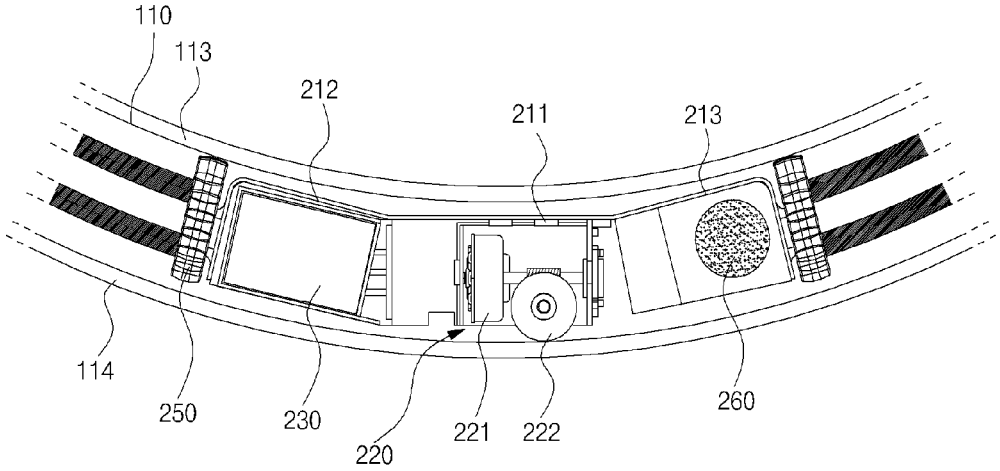
FIGS. 12 and 13 illustrate operations of the balancer installed in the balancer housing.
Figure 13:
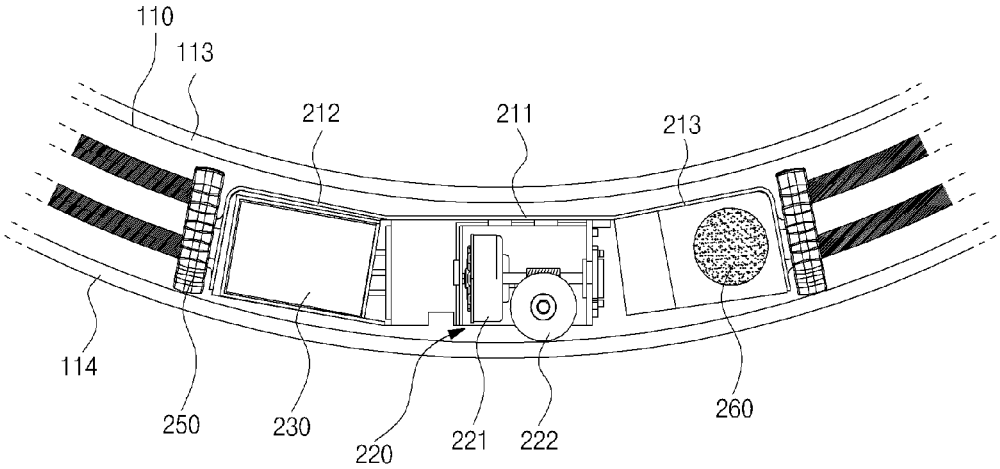

FIGS. 12 and 13 illustrate operations of the balancer installed in the balancer housing.

In more detail, FIG. 12 shows a state of the balancing module 200 when the rotary tub 30 (See FIG. 1) rotates at low speed or stops motion.

Referring to FIG. 12, a main plate 210 of the balancing module 200 maintains its own original state. Therefore, the center plate 211 is maintained at a predetermined angle with the lateral plates (212, 213).

As a result, the bearing 250 mounted to the end part of each lateral plate (212, 213) contacts with a first surface 113 formed in an inner surface of a radial direction from among inner surfaces of the balancer housing 110.

In this case, the contact part between the balancing module 200 and the balancer housing 110 contacts with a first surface 113, and the drive wheel 222 contacts with a second surface 114 formed at an external surface of a radial direction from among inner surfaces of the balancer housing 110.

Therefore, the drive wheel 222 is pressurized in the direction of the second surface 114.

FIG. 13 shows a state of the balancing module 200 when the rotary tub 20 (See FIG. 1) rotates at high speed.

Referring to FIG. 13, the angle between the center plate 211 and the lateral plate (212 or 213) is more increased in a static mode by centrifugal force. In other words, the lateral plates (212, 213) are spread out in an external direction of a radius.

The lateral plates (212, 213) are spread out, such that the bearing 250 and the drive wheel 222 contact with the second surface 114.

As a result, pressure applied to the drive wheel 222 is reduced so that the drive wheel 222 may be more freely rotated.

If the drive wheel 222 moves freely, the drive wheel 222 may enable the balancing module 200 to be easily shifted to a desired position.

That is, the balancing module 200 may be more freely shifted during high-speed rotation of the rotary tub 30, such that the balancing module 200 may be shifted to a position where unbalance of the rotary tub 30 may be more quickly reduced.

Figure 14:
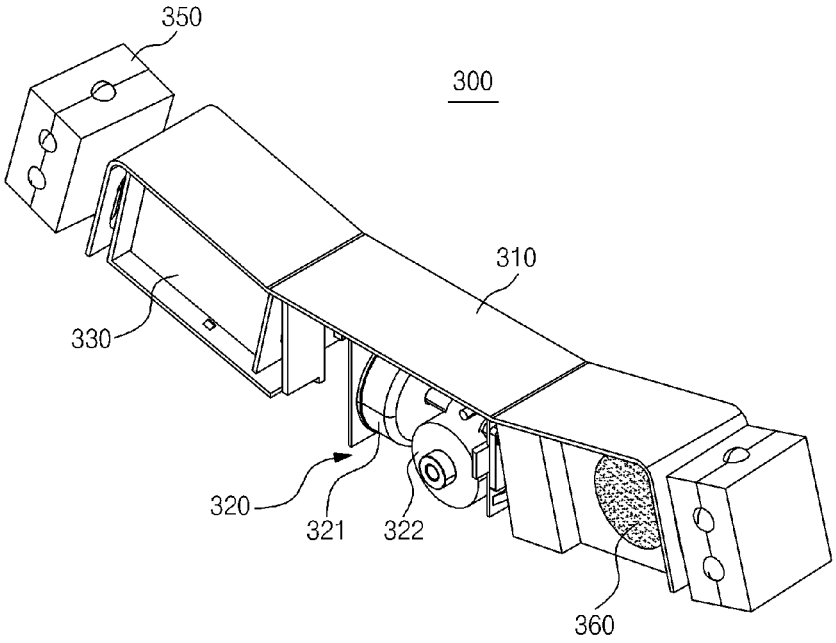
FIG. 14 is a diagram illustrating a balancing module according to another embodiment of the present disclosure.

FIG. 14 is a diagram illustrating the balancing module according to another embodiment of the present disclosure.

Referring to FIG. 14, a basic format of the balancing module 300 may be formed by the main plate 310.

A plurality of mass objects (not shown) may be mounted to the main plate 310. The driver 320 may be mounted to the main plate 310. A circuit board 330 may be mounted to the front surface of one of the mass objects. A position identification unit 360 may be mounted to one of the mass objects.

The driver 320 may include a drive wheel 322 to directly move the balancing module 300, and a drive motor 321 to operate the drive wheel 222.

A bearing 350 may be mounted to both end portions of the main plate 310.

For convenience of description and better understanding of the present disclosure, the bearing 350 may be a ball bearing, for example.

If the bearing 350 is implemented as the ball bearing, shifting the balancing module 300 within the balancer housing 110 (See FIG. 3) may be facilitated.

Figure 15:
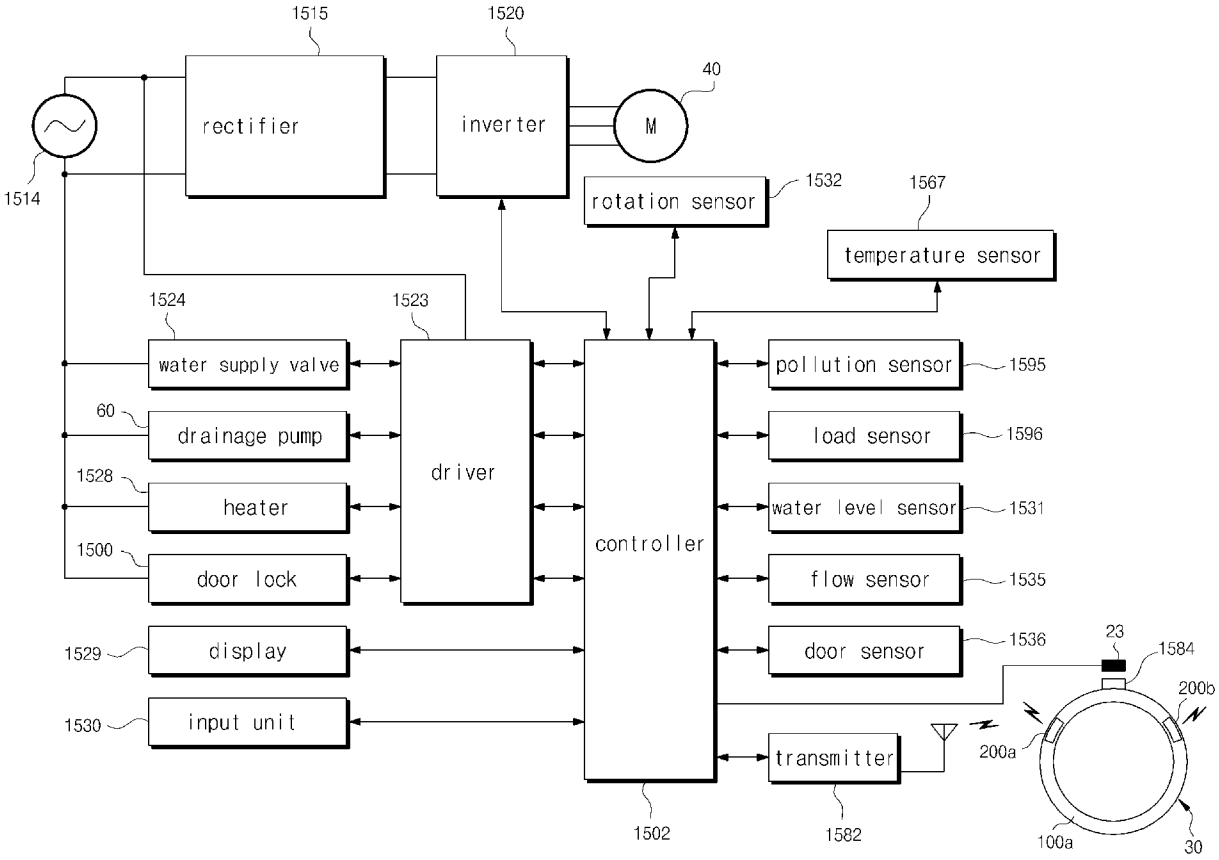
FIG. 15 is a block diagram illustrating a control system of the washing machine according to embodiments of the present disclosure.

FIG. 15 is a block diagram illustrating a control system of the washing machine according to embodiments of the present disclosure. Referring to FIG. 15, an Alternating Current (AC) power source 1514 is connected to a rectifier 1515 comprised of a diode bridge rectifier circuit, and is also connected to an inverter 1520 including a smoothing capacitor. The inverter 1520 may include a three-phase bridge circuit comprised of (Insulated Gate Bipolar Transistor (IGBT). An output terminal of each phase of the inverter 1520 is connected to a wire of each phase of a stator of the motor 40. A controller 1502 is configured to control a rotation speed and a rotation direction of the motor 40 through phase control of the inverter 1520.

The AC power from the AC power source 1514 may also be applied to a driver 1523, a water supply valve 1524, a drainage pump 60, a heater 1528, and a door lock 1500. The driver 1523 is configured to drive the water supply valve 1524, the drainage pump 60, the heater 1528, and the door lock 1500 in response to a control signal of the controller 1502. The water supply valve 1524 is used to supply wash water or rinsing water to the inside of the tub 20 or prevent the wash water or the rinsing water from being supplied to the tub 20. The drainage pump 60 is used to drain water from the tub 20 to the outside of the washing machine. A heater 1528 may be used to heat the wash water or the rinsing water, or may be used to heat air contained in the tub 20 during a drying cycle of the laundry. The door lock 1500 may maintain a locked state of the door 12 during the washing operation of the laundry.

In addition, a display 1529 and an input unit 1530 are connected to the controller 1502. The display 1529 is used to display the operation states or information messages of the washing machine. The input unit 1530 includes a plurality of buttons, for example, to allow the user to manipulate the washing machine. The display unit may be a touch screen for a user to input directly thereto.

The controller 1502 is connected to a water-level sensor 1531, a rotation sensor 1532, a flow sensor 1535, a door sensor 1536, a temperature sensor 1567, a pollution sensor 1595, and a load sensor 1596, such that the controller 1502 may communicate with them. The water-level sensor 1531 is used to detect a water level of wash water contained in the tub 20. The rotation sensor 1532 is used to detect the number of rotations (such as rpm) of the motor 40. The flow sensor 1535 may be used to detect the flow of water supplied to the inside of the tub 20. The flow sensor 1535 is used to determine whether water is supplied to the inside of the tub 20. The door sensor 1536 is used to detect an opening or closing state of the door 12. The temperature sensor 1567 may detect a temperature of the wash water or the rinsing water of the tub 20, or may detect a temperature of the air present in the tub 20. The pollution sensor 1595 may detect the degree of pollution of the wash water or the rinsing water present in the tub 20. For example, the pollution sensor 1595 may be an optical sensor to detect light transmittance of the wash water or the rinsing water. The load sensor 1596 may be used to detect laundry contained in the rotary tub 1530.

The controller 1502 to control overall operations of the washing machine may be implemented as a microprocessor or a microcomputer. The controller 1502 includes a control program or a variety of data for overall control of the washing machine. The controller 1502 receives not only information generated from the input unit 1530 but also detection signals of the water level sensor 1531, the rotation sensor 1532, the flow sensor 1535, the door sensor 1536, the temperature sensor 1567, the pollution sensor 1595, and the load sensor 1596; controls the water supply valve 1524, the drainage pump 60, the heater 1528, and the door lock 1500 through the driver 1523; and starts the washing operation of the washing machine by controlling the motor 40 through the inverter 1520. Any one of the washing cycle, the rinsing cycle, the dehydration cycle, and the drying cycle may be independently performed according to user selection.

The controller 1502 is connected to the transmitter 1582 and the position detection sensor 23, and communicates with them. The transmitter 1582 receives a movement command of the balancing modules (200*a*, 200*b*) of the balancer 100*a* from the controller 1502, and wirelessly transmits the movement command to the balancing modules (200*a*, 200*b*). In this case, the balancing module 200*a* may be identified as a first balancing module, and the balancing module 200*b* may be identified as a second balancing module. Each balancing module (200*a*, 200*b*) enables the inside of the balancer 100*a* to be shifted by a predetermined distance corresponding to the movement command upon receiving the movement command transferred through the transmitter 1582 from the controller 1502. A base 1584 is fixed at the outer surface of the balancer 100*a*. The position of the base 1584 may be used as a reference position to detect the position of each balancing module (200*a*, 200*b*). When the position of each balancing module (200*a*, 200*b*) is fixed in the balancer 100*a*, if the rotary tub 30 rotates, the positions of the base 1584 and two balancing modules (200*a*, 200*b*) may be recognized through the position detection sensor 23. The controller 1502 may recognize which one of parts of the balancer 100*a* includes the balancing modules (200*a*, 200*b*) on the basis of relative position information of the balancing modules (200*a*, 200*b*) of the base 1584. If the position detection sensor 23 is implemented as the hall sensor, the base 1584 may include a magnetic substance. If the position detection sensor 23 is implemented as the infrared sensor, the base 1584 may include a light emitting unit. If the position detection sensor 23 is implemented as the optical fiber sensor, the base 1584 may include a reflective plate. Although only the balancer 100*a* provided at the front surface of the rotary tub 30 is shown in FIG. 15 for convenience of description, it should be noted that another balancer 100*b* may also be provided at the rear surface of the rotary tub 30.

Figure 16:
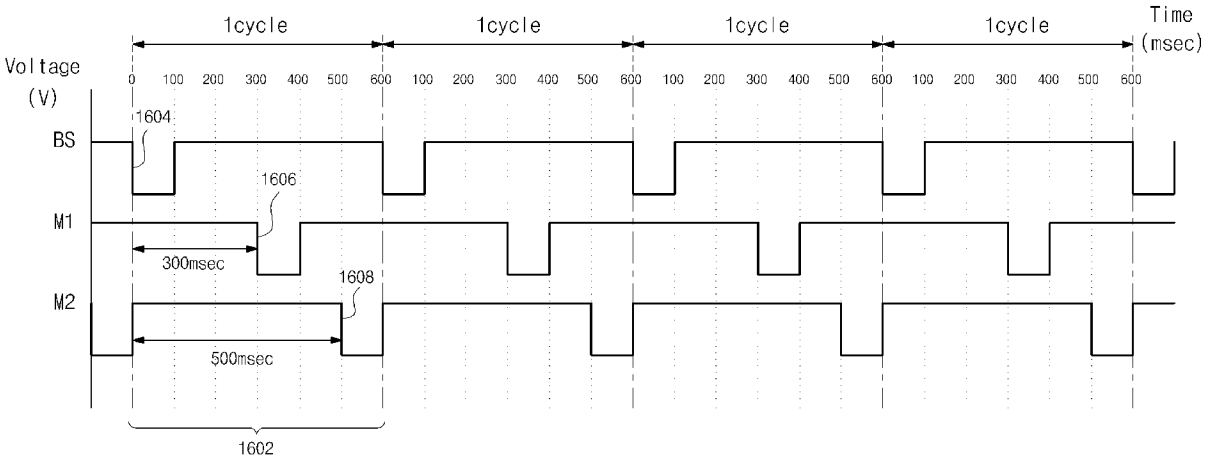
FIG. 16 illustrates output waveforms of a position detection sensor of the washing machine according to embodiments of the present disclosure.

FIG. 16 illustrates output waveforms of the position detection sensor of the washing machine according to embodiments of the present disclosure. As may be seen from FIG. 16, a horizontal axis denotes time, and a vertical axis denotes a voltage value. However, the voltage value on the vertical axis may be replaced with other electric characteristics such as a current or resistance. Referring to FIG. 16, the position detection sensor 23 generates a plurality of output signals each having a low level pulse whenever the base 1584 and the balancing modules (200*a*, 200*b*) pass through the part where the position detection sensor 23 is located. That is, the position detection sensor 23 generates a base detection signal (BS) indicating the position of the base 1584, and a low-level pulse is formed in the base detection signal (BS) whenever the base 1584 passes through the position detection sensor 23. In addition, the position detection sensor 23 generates a first balancing module signal M1 indicating the position of the first balancing module 200*a*. A low level pulse is formed in the first balancing module signal M1 whenever the first balancing module 200*a* passes through the position detection sensor 23. In addition, the position detection sensor 23 generates a second balancing module signal M2 indicating the position of the second balancing module 200*b*, and a low level pulse is formed in the second balancing module signal M2 whenever the second balancing module 200*b* passes through the position detection sensor 23. If the rotary tub 30 rotates clockwise (CW) when the position of each balancing module (200*a*, 200*b*) is fixed to the inside of the balancer 100*a*, the base 1584, the first balancing module 200*a*, and the second balancing module 200*b* rotate at the same speed and the same direction as in the rotary tub 30, resulting in the occurrence of output signals shown in FIG. 16. The positions of low level pulses of each output signal shown in FIG. 16 may correspond to the positions of the base 1584, the first balancing module 200*a*, and the second balancing module 200*b*. When the rotary tub 30 rotates about 100 RPM, one rotation period of the rotary tub 30 is about 600 msec which is about 360°. In FIG. 16, during a first rotation period 1602 of the rotary tub 30, the spacing between the base detection signal BS and the first balancing module signal M1 may be about 300 msec which is about 180°. In addition, the spacing between the base detection signal BS and the second balancing module signal M2 may be set to about 500 msec which is about 300°. If the relative positions of the balancing modules (200*a*, 200*b*) of the base 1584 are recognized, the movement direction and the movement distance of each balancing module (200*a*, 200*b*) may be recognized when the balancing modules (200*a*, 200*b*) must be shifted to remove unbalance caused by eccentricity of laundry. The controller 1502 recognizes the position of each balancing module (200*a*, 200*b*). If the balancing modules (200*a*, 200*b*) need to be shifted, a movement command to shift the balancing modules (200*a*, 200*b*) is generated and transferred to the transmitter 1582. The transmitter 1582 transmits the movement command to each balancing module (200*a*, 200*b*), such that each balancing module (200*a*, 200*b*) may be shifted by a predetermined distance corresponding to the movement command.

For this purpose, a unique communication ID and a module ID are assigned to the transmitter 1582 and the balancing modules (200*a*, 200*b*). For example, assuming that a module ID of the first balancing module 200*a* generating a first balancing module signal M1 is denoted by M1 and a communication ID corresponding to the module ID M1 is denoted by C1, the transmitter 1582 transmits a movement command (module ID=M1) of the first balancing module 200*a* through the communication ID (C1). In addition, assuming that a module ID of the second balancing module 200*b* generating a second balancing module signal M2 is denoted by M2 and a communication ID corresponding to the module ID M2 is denoted by C2, the transmitter 1582 transmits a movement command (module ID=M2) of the second balancing module 200*b* through the communication ID (C2). Each balancing module (200*a*, 200*b*) is configured to identify its own movement command through the module ID of the movement command transmitted from the transmitter 1582, thereby corresponding to the identified movement command. That is, if the module ID of the movement command is denoted by M1, the corresponding movement command is transferred to the first balancing module 200*a*. If the module ID is denoted by M2, the corresponding movement command is transferred to the second balancing module 200*b*.

Figure 17:
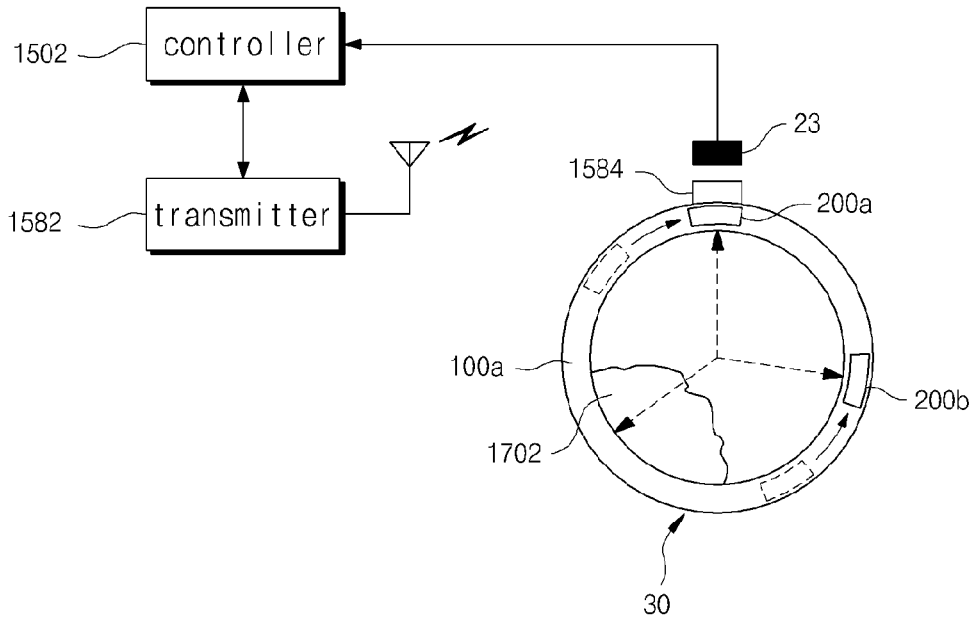
FIG. 17 is a conceptual diagram illustrating movement of the balancing module capable of removing unbalance of the washing machine according to embodiments of the present disclosure.

FIG. 17 is a conceptual diagram illustrating movement of the balancing module capable of removing unbalance of the washing machine according to embodiments of the present disclosure. Referring to FIG. 17, if laundry 1702 is not uniformly distributed in the rotary tub 30 but accumulates at one side, serious vibration occurs by unbalance caused by eccentricity of the laundry 1702 when the rotary tub 30 rotates at high speed. In order to remove unbalancing caused by eccentricity of the laundry 1702, the first balancing module 200*a* moves clockwise by a predetermined distance, and the second balancing module 200*b* moves counterclockwise by a predetermined distance. The movement direction and the movement distance of each balancing module (200*a*, 200*b*) are determined in a manner that centrifugal force caused by eccentricity of the laundry 1702 is offset by centrifugal force generated by each balancing module (200*a*, 200*b*). As may be seen from FIG. 17, the balancing module (200*a*, 200*b*) is shifted to the opposite side of the laundry 1702, such that it may be recognized that centrifugal force caused by eccentricity of the laundry 1702 may be offset by centrifugal force caused by the balancing module (200*a*, 200*b*).

Figure 18:
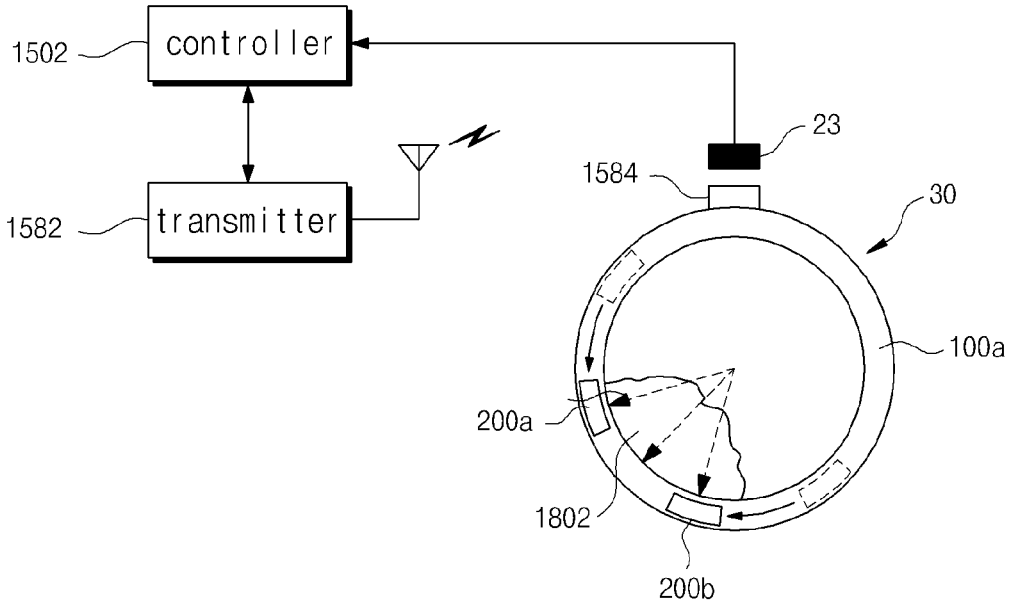
FIG. 18 is a conceptual diagram illustrating movement of the balancing module when erroneous recognition occurs between a transmitter and a balancing module of the washing machine according to embodiments of the present disclosure.

FIG. 18 is a conceptual diagram illustrating movement of the balancing module when erroneous recognition occurs between the transmitter and the balancing module of the washing machine according to embodiments of the present disclosure.

As previously stated in FIG. 16, a unique communication ID and a module ID are assigned to the transmitter 1582 and the balancing modules (200*a*, 200*b*). Each balancing module (200*a*, 200*b*) is configured to identify its own movement command through the module ID of the movement command transmitted from the transmitter 1582, such that each balancing module (200*a*, 200*b*) may correspond to the identified movement command. If the communication ID (C1 or C2) is correctly matched to the module ID (M1 or M2), the balancing module (200*a*, 200*b*) may be correctly shifted as shown in FIG. 17. However, if the communication ID (C1, C2) is incorrectly matched to the module ID (M1, M2), each balancing module (200*a*, 200*b*) is not shifted as intended by the controller 1502, such that unbalancing is not removed but added. For example, although the relationship of C1↔M1 and C2↔M2 should be normally achieved, a movement command generated by the controller 1502 which desires to move the first balancing module 200*a* is actually applied to the second balancing module 200*b* when the relationship of C1↔M2 and C2↔M1 is achieved, and a movement command generated by the controller 1502 which desires to move the second balancing module 200*b* is actually applied to the first balancing module 200*a*, such that the result opposite to an objective result intended by the controller 1502 may appear. If the communication ID (C1, C2) is incorrectly matched to the module ID (M1, M2), the movement command used to shift clockwise the first balancing module 200*a* is actually applied to the second balancing module 200*b* as shown in FIG. 18, such that the second balancing module 200*b* is shifted clockwise. In addition, the movement command used to shift counterclockwise the second balancing module 200*b* is actually applied to the first balancing module 200*a*, and the first balancing module 200*a* is shifted counterclockwise, shifting of the balancing module (200*a* or 200*b*) does not remove unbalance but increases the unbalance.

Figure 19A:
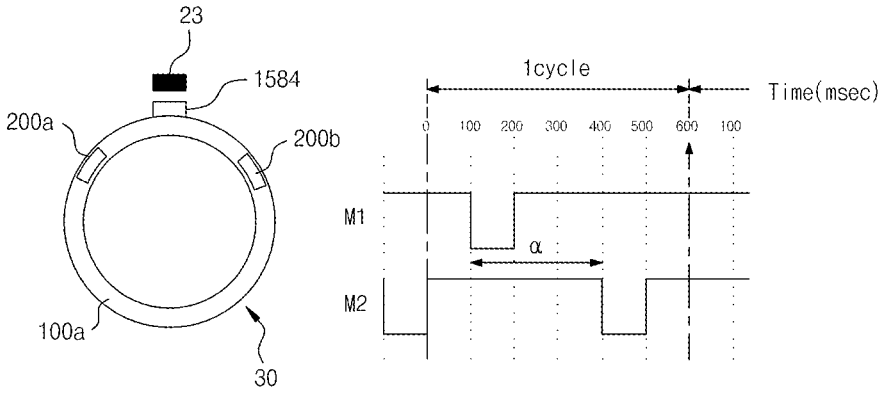
FIGS. 19A, 19B and 19C illustrate a variation of an output signal in response to movement of a first balancing module of the washing machine according to embodiments of the present disclosure.
Figure 19B:
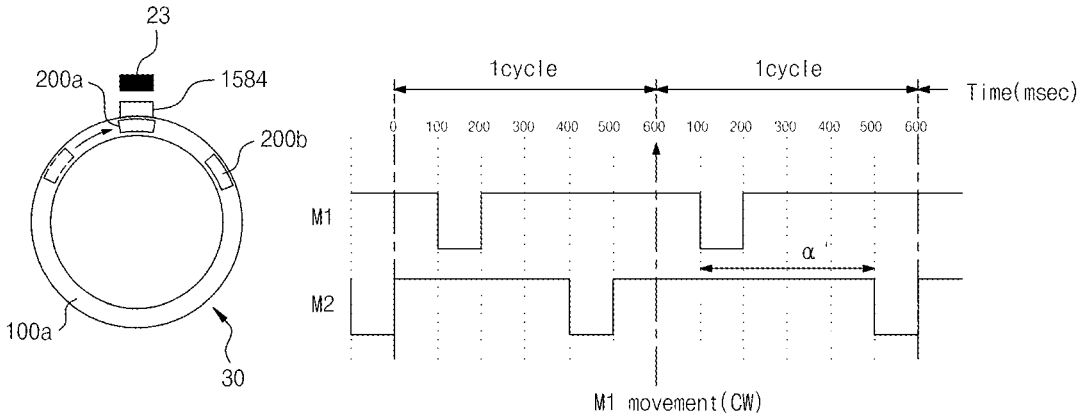
Figure 19C:
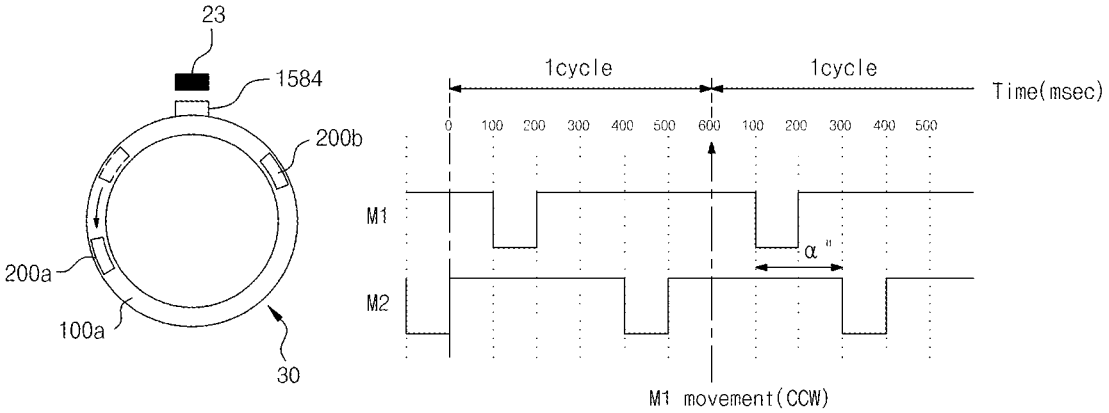

FIGS. 19A, 19B and 19C illustrate a variation of an output signal in response to movement of the first balancing module of the washing machine according to embodiments of the present disclosure. Referring to FIGS. 19A, 19B and 19C, it is assumed that the rotary tub 30 rotates clockwise (CW). As may be seen from FIG. 19A, if the rotary tub 30 rotates clockwise (CW) when the position of each balancing module (200*a*, 200*b*) in the balancer 100*a* is fixed, the output signals shown in FIG. 19A are generated in response to the positions of the first and second balancing modules (200*a*, 200*b*). Referring to respective detection signals of FIG. 19A, the positions of low level pulses respectively correspond to the positions of the first and second balancing modules (200*a*, 200*b*). Here, a time interval between a first time point at which the first balancing module 200*a* is detected and a second time point at which the second balancing module 200*b* is detected is referred to as a first time ($\alpha$).

As may be seen from FIG. 19B, if the first balancing module 200*a* is shifted clockwise by a predetermined distance when the second balancing module 200*b* maintains its own current position, it may be recognized that a time interval $\alpha'$ (i.e., second time) between a first time point at which the first balancing module 200*a* is detected and a second time point at which the second balancing module 200*b* is detected is larger than the above time interval $\alpha$ between the detection time points of FIG. 19A. If the first balancing module 200*a* is shifted clockwise when the rotary tub 30 rotates clockwise, the distance between the first balancing module 200*a* and the second balancing module 200*b* is further increased along the clockwise direction, such that the time interval $\alpha'$ (i.e., second time) of FIG. 19B is larger than the time interval $\alpha$ (i.e., first time) of FIG. 19A.

In contrast, if the first balancing module 200*a* is shifted counterclockwise by a predetermined distance when the second balancing module 200*b* maintains its own current position as shown in FIG. 19C, it may be recognized that a time interval α" between a first time point at which the first balancing module 200*a* is detected and a second time point at which the second balancing module 200*b* is detected is shorter than the above time interval α between the detection time points of FIG. 19A. If the first balancing module 200*a* is shifted counterclockwise when the rotary tub 30 rotates clockwise, the distance between the first balancing module 200*a* and the second balancing module 200*b* is gradually reduced along the clockwise direction, such that the time interval α" of FIG. 19C is shorter than the time interval α of FIG. 19A.

Figure 20A:
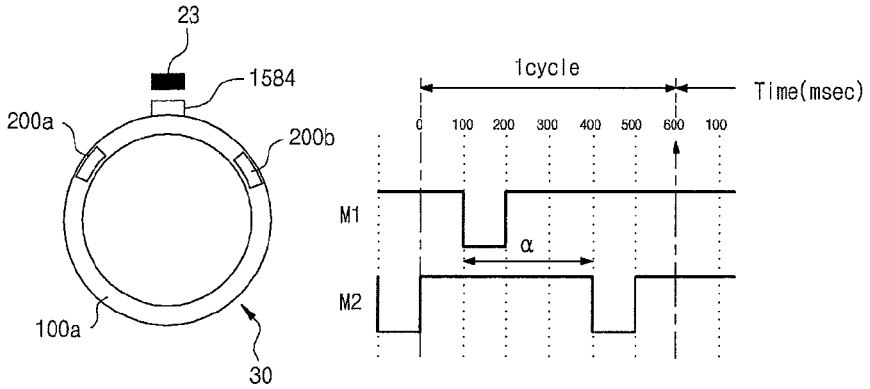
FIGS. 20A, 20B and 20C illustrate a variation of an output signal in response to movement of a second balancing module of the washing machine according to embodiments of the present disclosure.
Figure 20B:
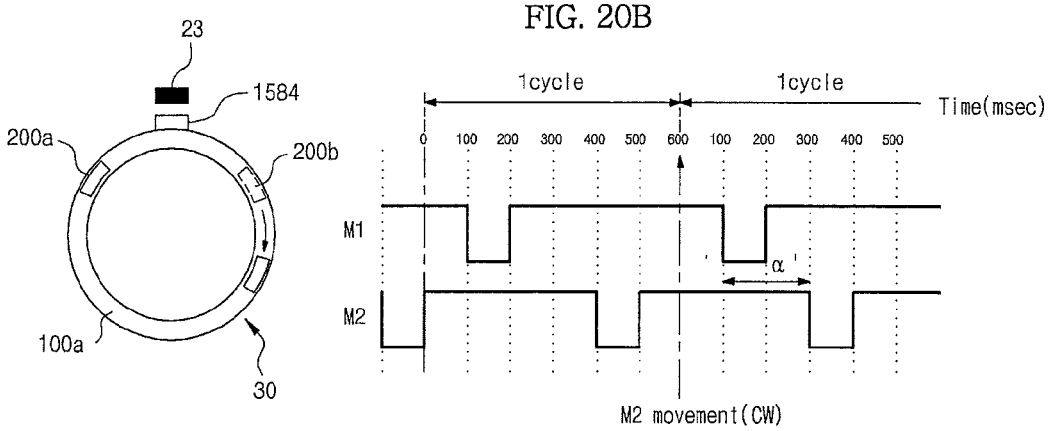
Figure 20C:
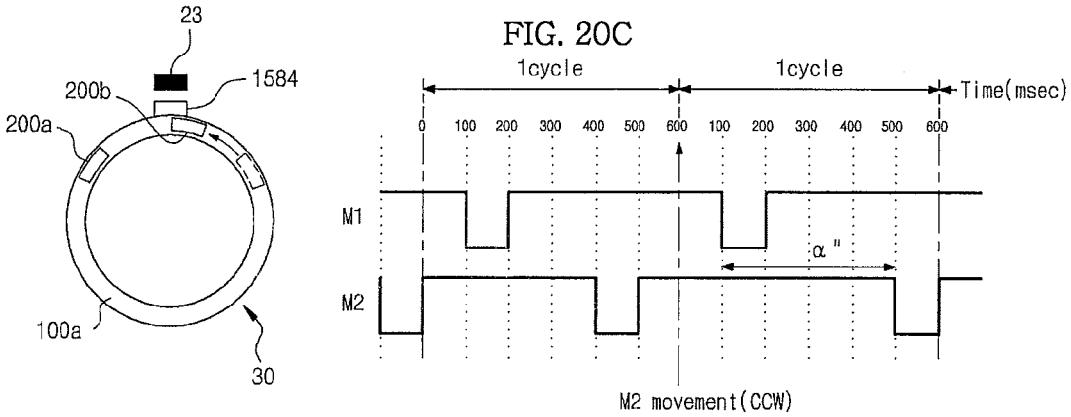

FIGS. 20A, 20B and 20C illustrate a variation of an output signal in response to movement of the second balancing module of the washing machine according to embodiments of the present disclosure. Referring to FIGS. 20A, 20B and 20C, it is assumed that the rotary tub 30 rotates clockwise (CW). As may be seen from FIG. 20A, if the rotary tub 30 rotates clockwise (CW) when the position of each balancing module (200*a*, 200*b*) in the balancer 100*a* is fixed, the output signals shown in FIG. 20A are generated in response to the positions of the first and second balancing modules (200*a*, 200*b*). Referring to respective detection signals of FIG. 20A, the positions of low level pulses respectively correspond to the positions of the first and second balancing modules (200*a*, 200*b*). Here, a time interval between a first time point at which the first balancing module 200*a* is detected and a second time point at which the second balancing module 200*b* is detected is referred to as a first time (α).

As may be seen from FIG. 20B, if the second balancing module 200*b* is shifted clockwise by a predetermined distance when the first balancing module 200*a* maintains its own current position, it may be recognized that a time interval α' between a first time point at which the first balancing module 200*a* is detected and a second time point at which the second balancing module 200*b* is detected is shorter than the above time interval α between the detection time points of FIG. 20A. If the second balancing module 200*a* is shifted clockwise when the rotary tub 30 rotates clockwise, the distance between the first balancing module 200*a* and the second balancing module 200*b* is gradually reduced along the clockwise direction, such that the time interval α' of FIG. 20B is shorter than the time interval α of FIG. 20A.

In contrast, if the second balancing module 200*b* is shifted counterclockwise by a predetermined distance when the first balancing module 200*a* maintains its own current position as shown in FIG. 20C, it may be recognized that a time interval α" between a first time point at which the first balancing module 200*a* is detected and a second time point at which the second balancing module 200*b* is detected is longer than the above time interval α between the detection time points of FIG. 20A. If the second balancing module 200*b* is shifted counterclockwise when the rotary tub 30 rotates clockwise, the distance between the first balancing module 200*a* and the second balancing module 200*b* is gradually increased along the clockwise direction, such that the time interval α" of FIG. 20C is longer than the time interval α of FIG. 20A.

Figure 21:
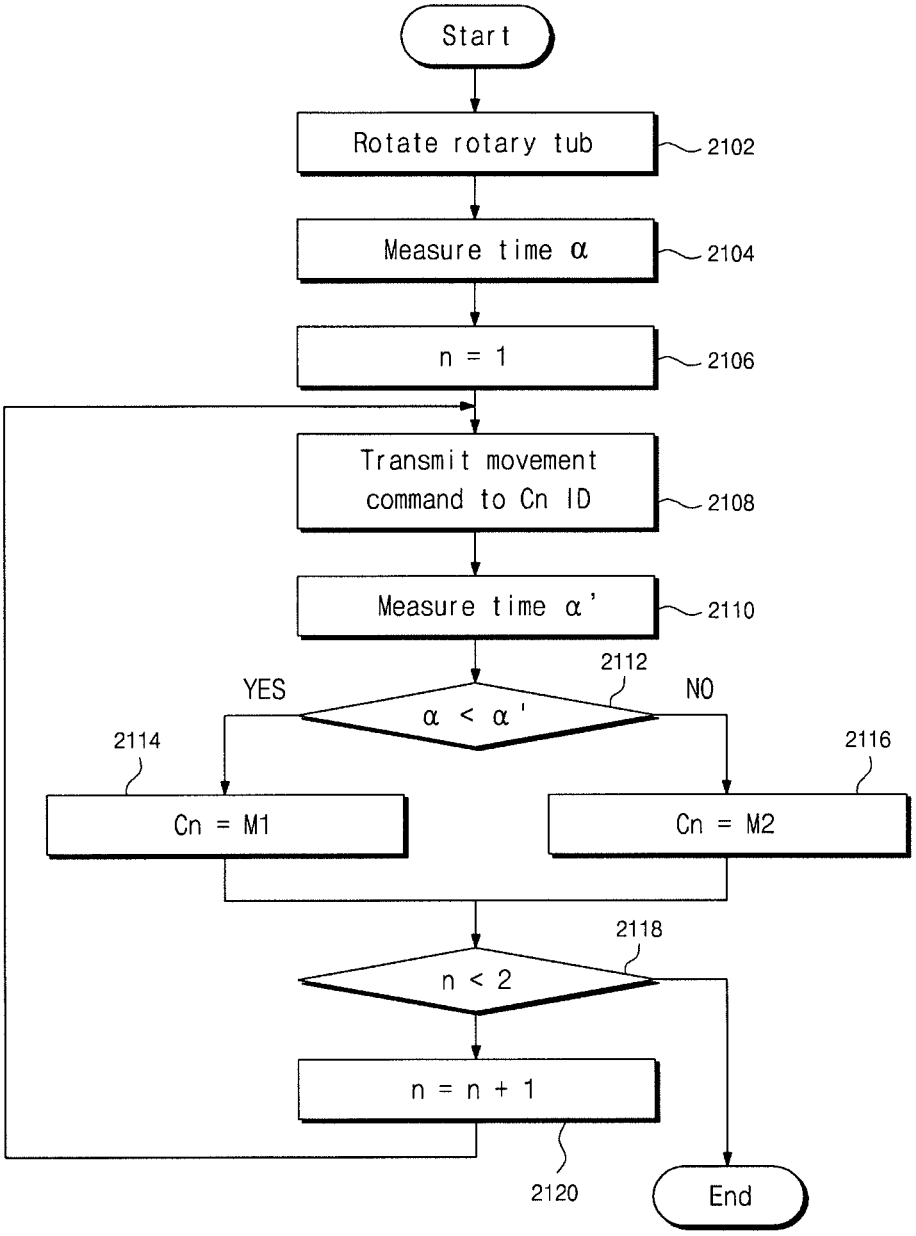
FIG. 21 is a flowchart illustrating a first control method of the washing machine according to embodiments of the present disclosure.

FIG. 21 is a flowchart illustrating a first control method of the washing machine according to embodiments of the present disclosure. The first control method of FIG. 21 is used to determine whether the communication ID (C1, C2) is correctly matched to the module ID (M1, M2) when the controller 1502 communicates with the balancing modules (200*a*, 200*b*) through the transmitter 1582. Specifically, the control method of FIG. 21 confirms the relationship between the communication ID (C1 or C2) and the module ID (M1 or M2) by independently shifting each of the balancing modules (200*a*, 200*b*), such that it may more correctly confirm the relationship between the communication ID (C1 or C2) and the module ID (M1 or M2). The control method of FIG. 21 may be used in the case where the balancer 100*a* is provided at any one of the front surface and the rear surface of the rotary tub 30.

The controller 1502 rotates the motor 40 in such a manner that the rotary tub 30 rotates clockwise about 100 RPM in operation 2102. In operation 2104, the controller 1502 measures a time interval α between a first time point (at which the first balancing module 200*a* is detected on the output signal of the position detection sensor 23) and a second time point (at which the second balancing module 200*b* is detected on the output signal of the position detection sensor 23) during clockwise rotation of the rotary tub 30 when the positions of the balancing modules (200*a*, 200*b*) in the balancer 100*a* are fixed. In this case, a variable (n) is initialized to n=1 in operation 2106. The controller 1502 transmits a movement command to the communication ID (Cn) in operation 2108. After transmission of the movement command, a time interval α' between a first time point at which the first balancing module 200*a* is detected and a second time point at which the second balancing module 200*b* is detected is measured in operation 2110. If the time interval α and the other time interval α' are measured, the controller 1502 compares the time interval α with the other time interval α' so that it determines whether or not the relationship of C1↔M1 (where n=1) is achieved. For example, when (α<α') is satisfied according to the comparison result of two time intervals (α, α') in operation 2112, the controller 1502 determines that the relationship of Cn=M1 (where n=1) is achieved in operation 2114 (See FIGS. 19A, 19B and 19C). On the other hand, when (α<α') is not satisfied according to the comparison result of two time intervals (α, α') in operation 2112, the controller 1502 determines that the relationship of Cn=M2 (where n=1) is achieved in operation 2116 (See FIGS. 20A, 20B and 20C). If any one of the balancing modules (200*a*, 200*b*) is completely recognized as described above, the variable (n) is increased to "n=n+1" such that the recognition process of the remaining balancing module 200*b* is repeated. The above-mentioned operations are performed for all the balancing modules (200*a*, 200*b*) in operations 2118 and 2120. That is, if the same recognition operations shown in FIG. 21 are applied to the balancing modules (200*a*, 200*b*), the movement command of the first balancing module 200*a* is generated, and the relationship of C1=M1 is recognized when α<α'. In addition, if the movement command of the second balancing module 200*b* is generated under the assumption of C2=M2, and when α<α' is satisfied, the relationship of C2=M2 is recognized. As described above, the controller 1502 independently moves each of the balancing modules (200*a*, 200*b*) and at the same time confirms the relationship of the communication ID (Cn) and the module ID (Mn), such that the controller 1502 may correctly recognize the relationship of the communication ID (Cn) and the module ID (Mn) of the balancing modules (200*a*, 200*b*).

Figure 22:
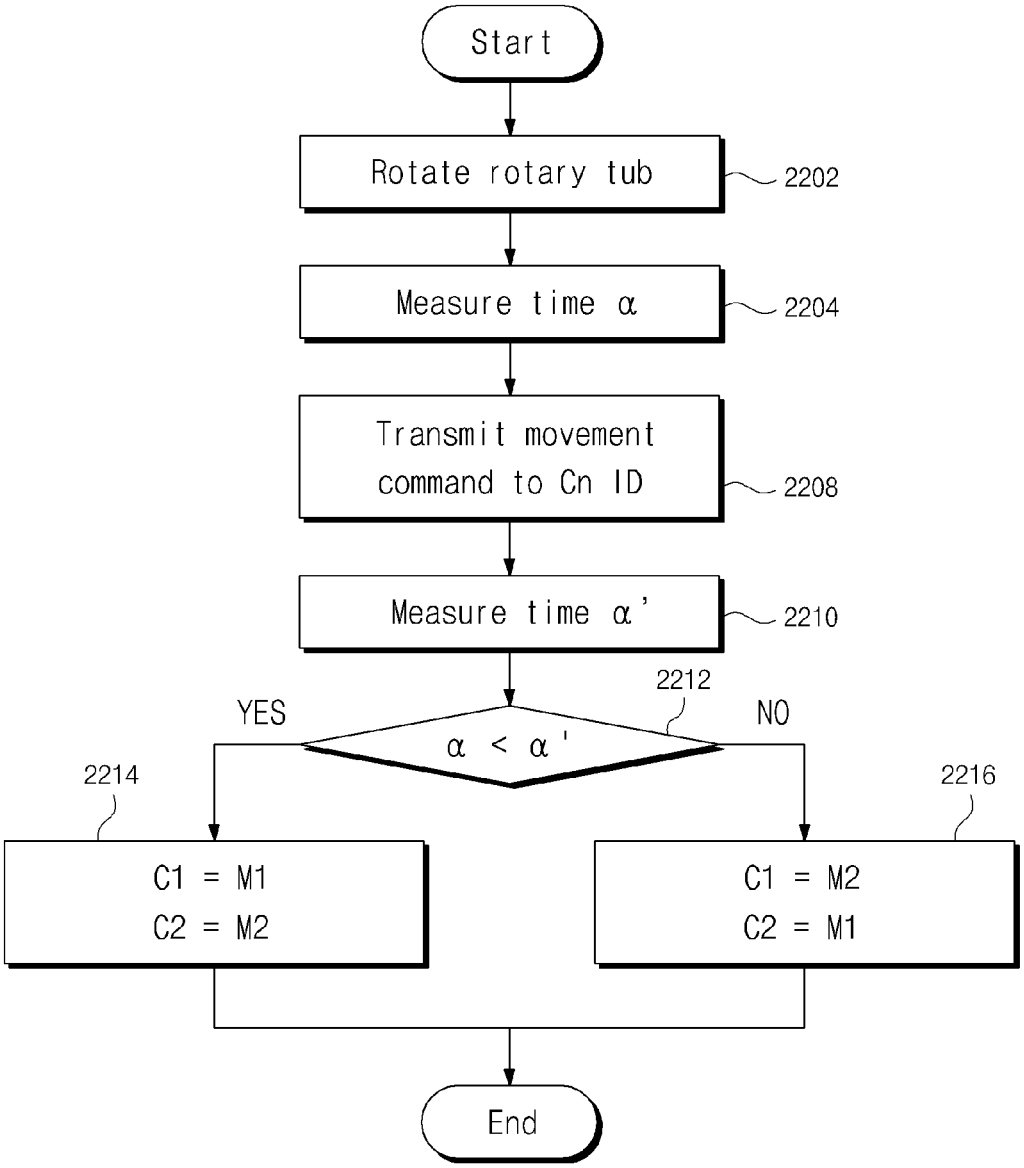
FIG. 22 is a flowchart illustrating a second control method of the washing machine according to embodiments of the present disclosure.

FIG. 22 is a flowchart illustrating a second control method of the washing machine according to embodiments of the present disclosure. The control method of FIG. 22 is used to confirm whether or not the communication ID (C1, C2) is correctly matched to the module ID (M1, M2) when the controller 1502 communicates with the balancing modules (200*a*, 200*b*) through the transmitter 1582. In accordance with the control method of FIG. 22, each of the remaining balancing modules other than any one of the balancing modules (200*a*, 200*b*) is shifted independently, such that the relationship between the communication ID (C1, C2) and the module ID (M1, M2) may be more quickly confirmed. The control method of FIG. 22 may be applied to the case in which the balancer 100*a* is provided at any one of the front surface and the rear surface of the rotary tub 30.

First, the controller 1502 rotates the rotary tub 30 in operation 2202. The controller 1502 drives the motor 40 in a manner that the rotary tub 30 rotates clockwise about 100 RPM. In operation 2204, the controller 1502 measures a time interval α between a first time point (at which the first balancing module 200*a* is detected on the output signal of the position detection sensor 23) and a second time point (at which the second balancing module 200*b* is detected on the output signal of the position detection sensor 23) during clockwise rotation of the rotary tub 30 when the positions of the balancing modules (200*a*, 200*b*) in the balancer 100*a* are fixed. The controller 1502 transmits a movement command to the communication ID (Cn) in operation 2208. As may be seen from FIG. 18, the controller 1502 assumes that the relationship of C1↔M1 and C2↔M2 is achieved, and transmits a movement command of the first balancing module 200*a* through the communication ID (C1). If movement of the first balancing module 200*a* is achieved by the above movement command, upon completion of the movement of the first balancing module 200*a*, the controller 1502 measures a time interval α' between a first time point at which the first balancing module 200*a* is detected and a second time point at which the second balancing module 200*b* is detected in operation 2210. If the time intervals (α, α') are measured, the controller 1502 compares the time interval (α) with the other time interval (α') and determines whether or not the relationship of C1↔M1 and C2↔M2 is achieved on the basis of the comparison result in operation 2212. For example, the controller 1502 compare two time intervals (α, α') with each other. When α<α' is satisfied in operation 2212, the controller 1502 determines that the relationship of C1=M1 is satisfied at the first balancing module 200*a*. Since the controller 1502 confirms the relationship of C1↔M1 at the first balancing module 200*a*, the controller 1502 determines that the relationship of C2↔M2 at the second balancing module 200*b* is automatically achieved without shifting the second balancing module 200*b* in operation 2214 (See FIGS. 19A, 19B and 19C). In conclusion, only one of two balancing modules (200*a*, 200*b*) is shifted, such that the controller 1502 confirms the relationship between the communication ID (Cn) and the module ID (Mn) in association with each of two balancing modules (200*a*, 200*b*). In contrast, the controller 1502 compares two time intervals (α, α') with each other. When α<α' is not satisfied in operation 2212, the controller 1502 determines that the relationship of C1↔M2 and C2↔M1 is achieved in operation 2216 (See FIGS. 20A, 20B and 20C) in a similar way to the operation 2214. In this way, the controller 1502 independently moves only one of two balancing modules (200*a*, 200*b*) simultaneously while confirming the relationship of the communication ID (Cn) and the module ID (Mn), and automatically establishes the relationship of the other communication ID (Cn) and the other module ID (Mn), such that it may more quickly recognize the relationship of the communication ID (Cn) and the module ID (Mn) of each balancing module (200*a*, 200*b*). If there are three balancing modules, the controller 1502 confirms the relationship of the communication ID (Cn) and the module ID (Mn) on the basis of a variation of the time intervals (α, α') dependent upon the movement of two balancing modules. Through the above-mentioned method, the confirmation process of the relationship between the communication ID (Cn) and the module ID (Mn) for the last balancing module may be omitted, such that a desired task may be more rapidly achieved.

Figure 23:
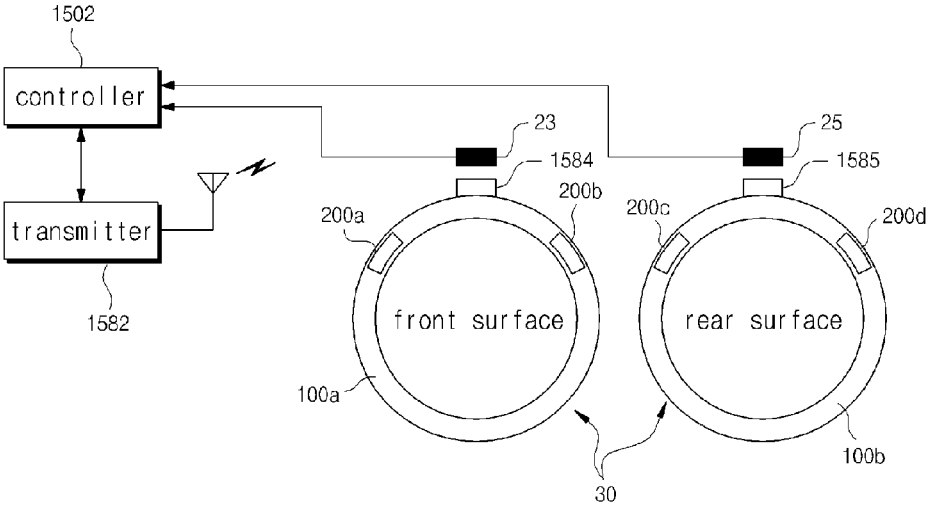
FIG. 23 is a conceptual diagram illustrating a washing machine including two balancers and four balancing modules according to embodiments of the present disclosure.

FIG. 23 is a conceptual diagram illustrating a washing machine including two balancers and four balancing modules according to embodiments of the present disclosure. Referring to FIG. 23, the front balancer 100*a*, the balancing modules (200*a*, 200*b*), the base 1584, and the position detection sensor 23, which are identical to those of FIG. 15, are provided at the front surface of the rotary tub 30. The rear balancer 100*b*, the balancing modules (200*c*, 200*d*), the base 1585, and the position detection sensor 25 are provided at the rear surface of the rotary tub 30 in the same manner as in the front surface of the rotary tub 30.

Figure 24:
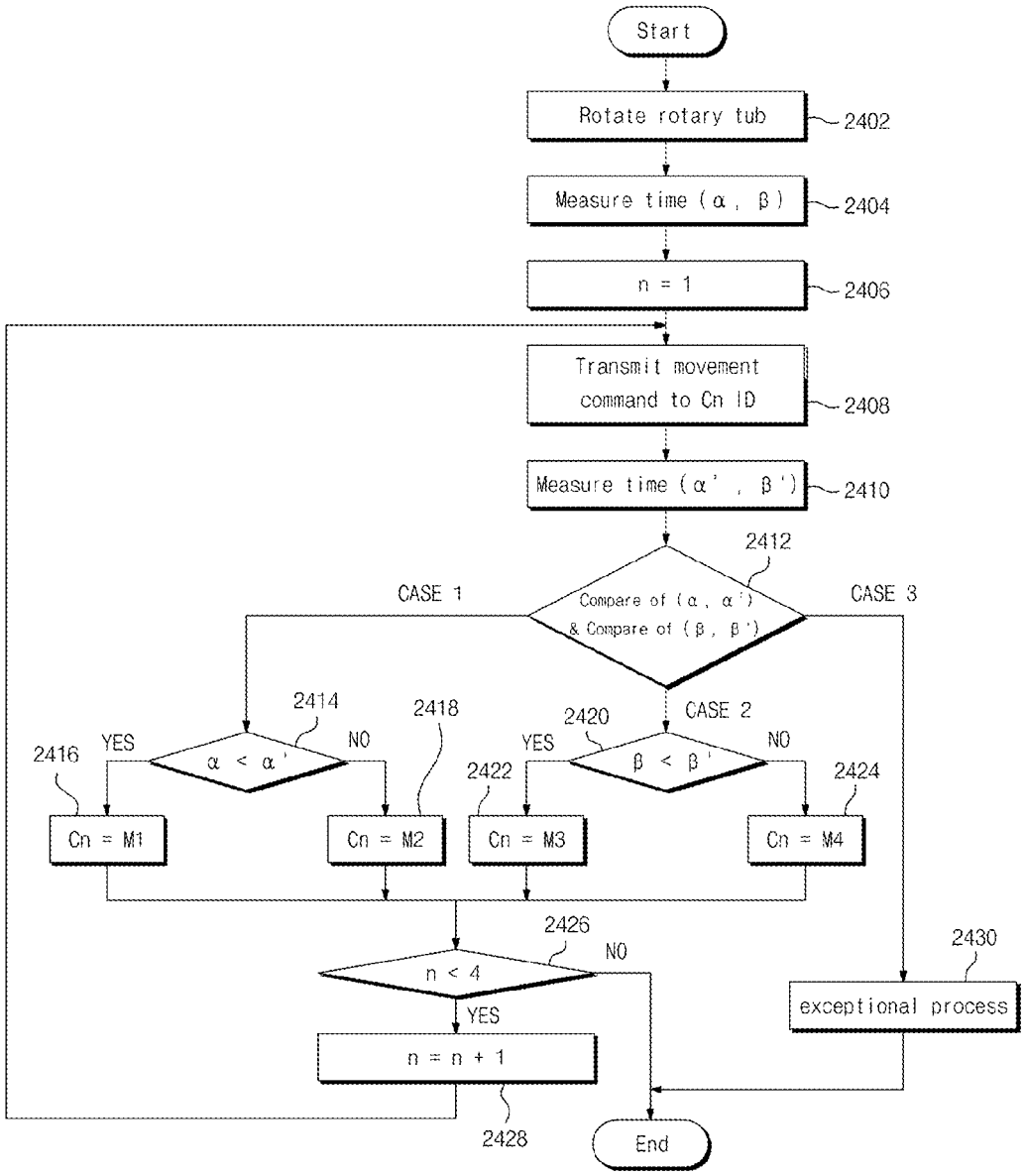
FIG. 24 is a flowchart illustrating a third control method of the washing machine according to embodiments of the present disclosure.

FIG. 24 is a flowchart illustrating a third control method of the washing machine according to embodiments of the present disclosure. The third control method of FIG. 24 is used to determine whether or not the communication ID (C1, C2, C3, C4) is correctly matched to the module ID (M1, M2, M3, M4) when the controller 1502 communicates with the balancing modules (200*a*, 200*b*, 200*c*, 200*d*) through the transmitter 1582. Specifically, the control method of FIG. 24 confirms the relationship between the communication ID (C1, C2, C3, C4) and the module ID (M1, M2, M3, M4) by independently shifting each of the balancing modules (200*a*, 200*b*, 200*c*, 200*d*), such that it may more correctly confirm the relationship between the communication ID (C1, C2, C3, C4) and the module ID (M1, M2, M3, M4). The control method of FIG. 24 may be used in the case where the balancers (100*a*, 100*b*) are respectively provided at the front surface and the rear surface of the rotary tub 30.

First, the controller 1502 rotates the rotary tub 30 in operation 2402. The controller 1502 drives the motor 40 in a manner that the rotary tub 30 rotates clockwise about 100 RPM. In operation 2404, during clockwise rotation of the rotary tub 30 when the positions of the balancing modules (200*a*, 200*b*, 200*c*, 200*d*) in the balancers (100*a*, 100*b*) are fixed, the controller 1502 measures a time interval α between a first time point (at which the first balancing module 200*a* is detected on the output signal of the position detection sensor 23 or 25) and a second time point (at which the second balancing module 200*b* is detected on the output signal of the position detection sensor 23 or 25), and also measures a time β (first time) between a third time point (at which the third balancing module 200*c* is detected) and a fourth time point (at which the fourth balancing module 200*d* is detected). In this case, a variable (n) is initialized to n=1 in operation 2406. The controller 1502 transmits a movement command to the communication ID (Cn) in operation 2408. As may be seen from FIG. 18, the controller 1502 assumes that the relationship of (C1↔M1, C2↔M2, C3↔M3, C4↔M4) is achieved, and transmits a movement command of the first balancing module 200*a* through the communication ID (C1). If movement of the first balancing module 200*a* is achieved by the above movement command, after completion of the movement of the first balancing module 200*a* of the front balancer 100*a*, the controller 1502 measures a time interval α' between a first time point at which the first balancing module 200*a* is detected and a second time point at which the second balancing module 200*b* is detected in operation 2410, and also measures a time interval β' (second time) between a third time point at which the third balancing module 200*c* is detected and a fourth time point at which the fourth balancing module 200*d* is detected after completion of the movement of the third balancing module 200*c* of the rear balancer 100*b* in operation 2410. If the time intervals (α, α', β, β') are measured, the controller 1502 compares two time intervals (α, α') with each other and compares two time intervals (β, β') with each other, and determines whether or not the relationship of C1↔ M1 is achieved on the basis of the comparison result in operation 2412. For example, in CASE 1, when the controller 1502 compare two time intervals (α, α') with each other, if the condition of α<α' is satisfied in operation 2414, the controller 1502 determines that the relationship of Cn=M1 (where n=1) is achieved in operation 2416 (See FIGS. 19A, 19B and 19C). In contrast, when the controller 1502 compares two time intervals (α, α') with each other, if the condition of α<α' is not satisfied in operation 2414, the controller 1502 determines that the relationship of Cn=M2 (where n=1) is achieved in operation 2418 (See FIGS. 20A, 20B and 20C). The controller 1502 compares two time intervals (β, β') with each other in the same manner as in the above method. For example, in CASE 2, if the condition of β<β' is satisfied in operation 2420, the controller 1502 determines that the relationship of Cn=M3 (where n=1) is achieved in operation 2422 (See FIGS. 19A, 19B and 19C). In contrast, when the controller 1502 compares two time intervals (β, β') with each other, if the controller 1502 determines that when β<β' is not satisfied in operation 2420, it determines that the relationship of Cn=M4 (where n=1) is achieved in operation 2424 (See FIGS. 20A, 20B and 20C). If any one of the balancing modules (200*a*, 200*b*) is completely recognized as described above, the variable (n) is increased to "n=n+1" such that the recognition process of the remaining balancing module 200*b* is repeated. The above-mentioned operations are performed for all the balancing modules (200*a*, 200*b*, 200*c*, 200*d*) in operations 2426 and 2428. That is, if the same recognition operations shown in FIG. 24 are applied to the balancing modules (200*a*, 200*b*, 200*c*, 200*d*), it is assumed that the front balancer 100*a* has the relationship of C1=M1 and the movement command of the first balancing module 200*a* is generated, such that the relationship of C1=M1 is recognized when α<α'. In addition, if the movement command of the second balancing module 200*b* is generated under the assumption of C2=M2, and when α<α' is satisfied, the relationship of C2=M2 is recognized. In the same manner as in the front balancer 100*a*, it is assumed that the rear balancer 100*b* has the relationship of C3=M3 and the movement command of the third balancing module 200*c* is generated. Thereafter, when β<β' is satisfied, the relationship of C3=M3 is recognized. In addition, if the movement command of the fourth balancing module 200*d* is generated under the assumption of C4=M4, and when β<β' is satisfied, the relationship of C4=M4 is recognized. As described above, the controller 1502 independently moves each of the balancing modules (200*a*, 200*b*, 200*c*, 200*d*) and at the same time confirms the relationship of the communication ID (Cn) and the module ID (Mn), such that the controller 1502 may correctly recognize the relationship of the communication ID (Cn) and the module ID (Mn) of the balancing modules (200*a*, 200*b*, 200*c*, 200*d*). In the comparison result 2412 of the time intervals (α, α') and the time intervals (β, β'), CASE 3 may indicate that no time difference occurs not only between the time intervals (α, α') but also between the time intervals (β, β'), or may indicate that a little variation occurs not only between the time intervals (α, α') but also between the time intervals (β, β'). In this case, an exceptional process is provided in operation 2430. For example, if no variation or the little variation is less than a predetermined variation, the exceptional process is provided in operation 2430. That is, if no time difference occurs between time intervals (α, α') or (β, β'), this means that any one of the balancing modules (200*a*, 200*b*, 200*c*, 200*d*) is not shifted by the movement command, to the controller may not correctly recognize the relationship between the communication ID (Cn) and the module ID (Mn) of the balancing modules (200*a*, 200*b*, 200*c*, 200*d*). In addition, the occurrence of a time difference between time intervals (a, α') and the occurrence of a time difference between time intervals (β, β') may indicate that at least two balancing modules are simultaneously shifted by one movement command. In this case, the controller may not correctly recognize the relationship between the communication ID (Cn) and the module ID (Mn) of the balancing modules (200*a*, 200*b*, 200*c*, 200*d*). Therefore, an exceptional process is provided for the above-mentioned case, such that an error code may be preferably displayed or a process to solve the problem may be preferably carried out through the exceptional process.

Figure 25:
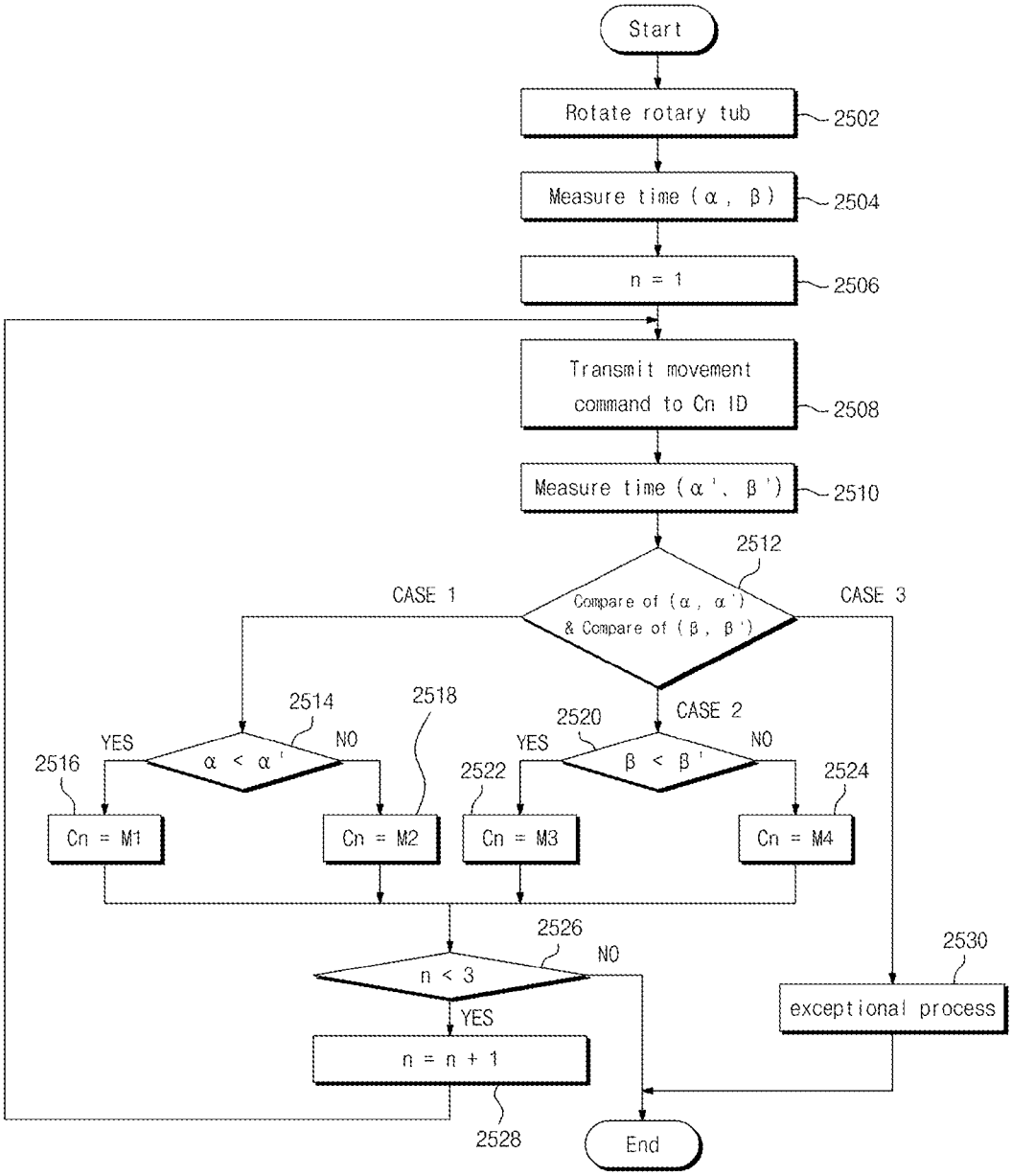
FIG. 25 is a flowchart illustrating a fourth control method of the washing machine according to embodiments of the present disclosure.

FIG. 25 is a flowchart illustrating a fourth control method of the washing machine according to embodiments of the present disclosure. The third control method of FIG. 24 is used to determine whether or not the communication ID (C1, C2, C3, C4) is correctly matched to the module ID (M1, M2, M3, M4) when the controller 1502 communicates with the balancing modules (200*a*, 200*b*, 200*c*, 200*d*) through the transmitter 1582. Specifically, the control method of FIG. 25 confirms the relationship between the communication ID (C1, C2, C3, C4) and the module ID (M1, M2, M3, M4) by independently shifting only some parts of the balancing modules (200*a*, 200*b*, 200*c*, 200*d*), such that it may more correctly confirm the relationship between the communication ID (C1, C2, C3, C4) and the module ID (M1, M2, M3, M4). The control method of FIG. 25 may be used in the case where the balancers (100*a*, 100*b*) are respectively provided at the front surface and the rear surface of the rotary tub 30.

First, the controller 1502 rotates the rotary tub 30 in operation 2502. The controller 1502 drives the motor 40 in a manner that the rotary tub 30 rotates clockwise about 100 RPM. In operation 2504, during clockwise rotation of the rotary tub 30 when the positions of the balancing modules (200*a*, 200*b*, 200*c*, 200*d*) in the balancers (100*a*, 100*b*) are fixed, the controller 1502 measures a time interval α between a first time point (at which the first balancing module 200*a* is detected on the output signal of the position detection sensor 23 or 25) and a second time point (at which the second balancing module 200*b* is detected on the output signal of the position detection sensor 23 or 25), and also measures a time β between a third time point (at which the third balancing module 200*c* is detected) and a fourth time point (at which the fourth balancing module 200*d* is detected). In this case, a variable (n) is initialized to n=1 in operation 2506. The controller 1502 transmits a movement command to the communication ID (Cn) in operation 2508. As may be seen from FIG. 18, the controller 1502 assumes that the relationship of (C1↔ M1, C2↔ M2, C3↔ M3, C4↔ M4) is achieved, and transmits a movement command of the first balancing module 200*a* through the communication ID (C1). If movement of the first balancing module 200*a* is achieved by the above movement command, after completion of the movement of the first balancing module 200*a* of the front balancer 100*a*, the controller 1502 measures a time interval α' between a first time point at which the first balancing module 200*a* is detected and a second time point at which the second balancing module 200*b* is detected in operation 2510, and also measures a time interval β' between a third time point at which the third balancing module 200*c* is detected and a fourth time point at which the fourth balancing module 200*d* is detected in operation 2510. If the time intervals (α, α', β, β') are measured, the controller 1502 compares two time intervals (α, α') with each other and compares two time intervals (β, β') with each other, and determines whether or not the relationship of Cn↔M1 is achieved on the basis of the comparison result in operation 2512. For example, in CASE 1, when the controller 1502 compare two time intervals (α, α') with each other, if the condition of α<α' is satisfied in operation 2514, the controller 1502 determines that the relationship of C1=M1 of the first balancing module 200*a* is achieved in operation 2516 (See FIGS. 19A, 19B and 19C). In contrast, when the controller 1502 compares two time intervals (α, α') with each other, if the condition of α<α' is not satisfied in operation 2514, the controller 1502 determines that the relationship of C2=M2 of the second balancing module 200*b* is achieved in operation 2518 (See FIGS. 20A, 20B and 20C). The controller 1502 compares two time intervals (β, β') with each other in the same manner as in the above method. For example, in CASE 2, when β<β' is satisfied in operation 2520, the controller 1502 determines that the relationship of Cn=M3 (where n=1) is achieved in operation 2522 (See FIGS. 19A, 19B and 19C). In contrast, when the controller 1502 compares two time intervals (β, β') with each other, if the condition of β<β' is not satisfied in operation 2520, the controller 2520 determines that the relationship of Cn=M4 (where n=1) is achieved in operation 2524 (See FIGS. 20A, 20B and 20C). If any one of the balancing modules (200*a*, 200*b*) is completely recognized as described above, the variable (n) is increased to "n=n+1" such that the recognition process of the remaining balancing module 200*b* other than the fourth balancing module 200*d* is repeated in operations 2526 and 2528. That is, if the same recognition operations shown in FIG. 24 are applied to the balancing modules (200*a*, 200*b*, 200*c*, 200*d*), the front balancer 100*a* generates a movement command of the first balancing module 200*a*, and the relationship of C1=M1 is recognized under the condition of α<α'. In addition, if the movement command of the second balancing module 200*b* is generated under the assumption of C2=M2, and if the condition of α<α' is satisfied, the relationship of C2=M2 is recognized. In the same manner as in the front balancer 100*a*, it is assumed that the rear balancer 100*b* assumes the relationship of C3=M3 and generates a movement command of the third balancing module 200*c*. Thereafter, if the condition of β<β' is satisfied, the relationship of C3=M3 is recognized. If the relationship between the communication ID (Cn) and the module ID (Mn) of the balancing modules (200*a*, 200*b*, 200*c*) is completely confirmed, the relationship of C4↔M4 is automatically designated without an exceptional confirmation process for the fourth balancing module 200*d*. In this way, the controller 1502 confirms the relationship between the communication ID (Cn) and the module ID (Mn) through the movement of each balancing module (200*a*, 200*b*, 200*c*), and determines the relationship between the communication ID (Cn) and the module ID (Mn) of the last balancing module 200*d* without movement, such that the controller 1502 may quickly recognize the relationship between the communication ID (Cn) and the module ID (Mn) of each balancing module (200*a*, 200*b*, 200*c*, 200*d*). In the comparison result 2512 of the time intervals (α, α') and the time intervals (β, β'), CASE 3 may indicate that no time difference occurs not only between the time intervals (α, α') but also between the time intervals (β, β'), or may indicate that a little variation occurs not only between the time intervals (α, α') but also between the time intervals (β, β'). In this case, an exceptional process is provided in operation 2530. That is, if no time difference occurs between time intervals (α, α') or (β, β'), this means that any one of the balancing modules (200*a*, 200*b*, 200*c*, 200*d*) is not shifted by the movement command, to the controller may not correctly recognize the relationship between the communication ID (Cn) and the module ID (Mn) of the balancing modules (200*a*, 200*b*, 200*c*, 200*d*). In addition, the occurrence of a time difference between time intervals (α, α') and the occurrence of a time difference between time intervals (β, β') may indicate that at least two balancing modules are simultaneously shifted by one movement command. In this case, the controller may not correctly recognize the relationship between the communication ID (Cn) and the module ID (Mn) of the balancing modules (200*a*, 200*b*, 200*c*, 200*d*). Therefore, an exceptional process is provided for the above-mentioned case, such that an error code may be preferably displayed or a process to solve the problem may be preferably carried out through the exceptional process.

The communication ID (C1, C2) is incorrectly matched to the module ID (M1, M2) due to a faulty operation of a fabrication process of products or due to unexpected errors of firmware or software. Therefore, the embodiment of the present disclosure may be applied not only to the fabrication process of products but also the sold products, such that correct communication may be preferably achieved between the controller 1502 and the balancing modules (200*a*, 200*b*). In the case of the product fabrication process, the embodiment of the present disclosure may be applied to the corresponding assembly process or the quality control process. The embodiment of the present disclosure may also be applied to the sold products through an initialization menu or the like.

Figure 26:
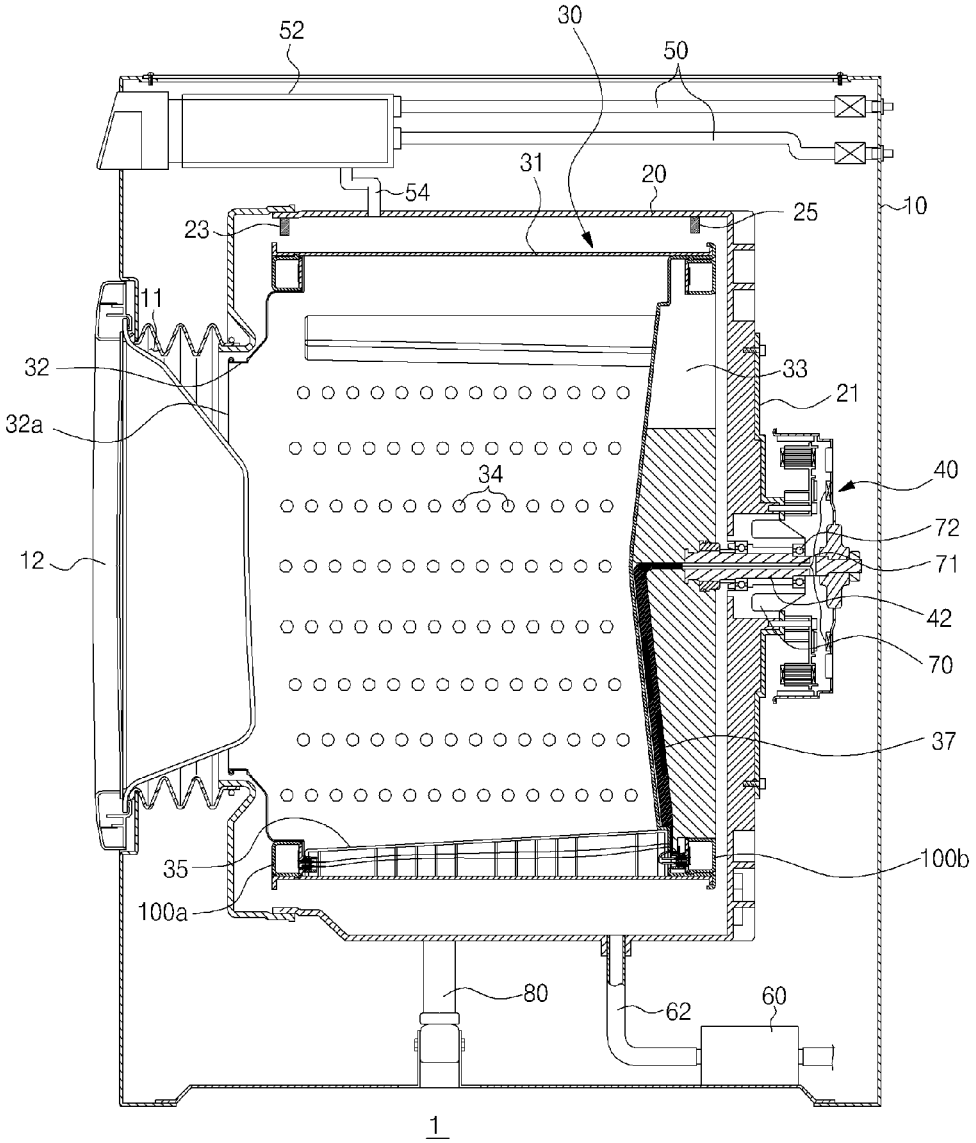
FIG. 26 is a schematic diagram illustrating internal components of a washing machine according to another embodiment of the present disclosure.

FIG. 26 is a schematic diagram illustrating internal components of a washing machine according to another embodiment of the present disclosure. The components of the washing machine shown in FIG. 26 are very similar to those of FIG. 1. However, the bases (1584, 1585) installed at the outer surface of the rotary tub 30 of FIG. 1 are not installed into the washing machine of FIG. 26. The bases (1584, 1585) installed into the washing machine of FIG. 1 are used to provide a reference position capable of recognizing the positions of the balancing modules (200*a*, 200*b*, 200*c*, 200*d*). The washing machine shown in FIG. 26 may recognize the positions of the balancing modules (200*a*, 200*b*, 200*c*, 200*d*) without using the bases, such that the number of electronic components may be reduced, resulting in reduction of difficulty in base installation.

Figure 27:
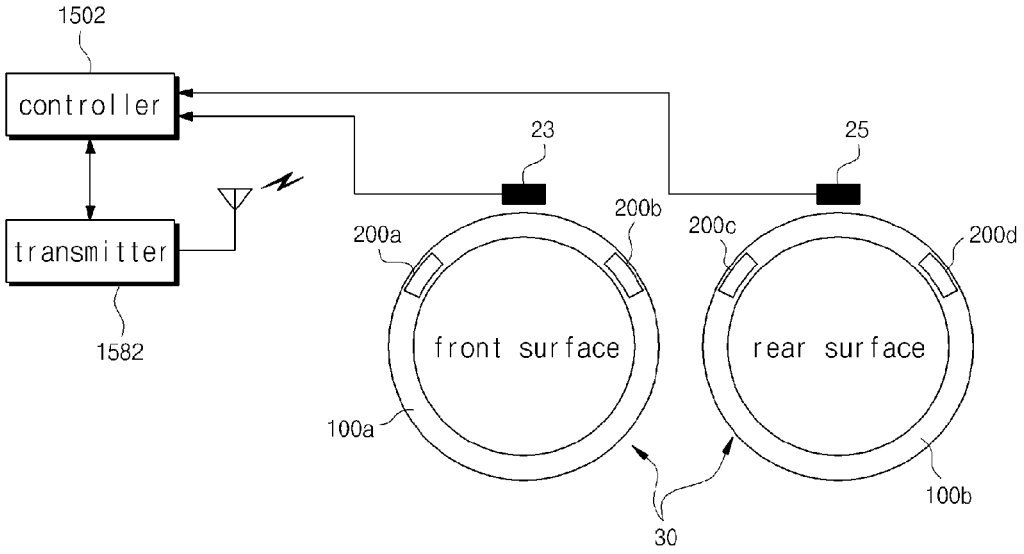
FIG. 27 is a schematic diagram illustrating a balancer of the washing machine shown in FIG. 26.

FIG. 27 is a schematic diagram illustrating a balancer of the washing machine shown in FIG. 26. Referring to FIG. 27, the front balancer 100*a*, the balancing modules (200*a*, 200*b*), and the position detection sensor 23 identical in structure to those of FIG. 15 are provided at the front surface of the rotary tub 30. The rear balancer 100*b*, the balancing modules (200*c*, 200*d*), and the position detection sensor 25 identical in structure to those of FIG. 15 are also provided at the rear surface of the rotary tub 30.

FIGS. 28A and 28B are conceptual diagrams illustrating a method for detecting a position of each balancing module for use in the balancer of the washing machine shown in FIG. 26. FIG. 28A shows an exemplary case in which the balancer 100*a* is installed only at the front surface of the rotary tub 30, and FIG. 28B shows an exemplary case in which the balancers (100*a*, 100*b*) are installed into both of the front surface and the rear surface of the rotary tub 30. In accordance with the washing machine of FIGS. 28A and 28B, a signal detected from the base is not used as a reference signal, and any one of signals (M1, M2, M3, M4) detected from the balancing modules (200*a*, 200*b*, 200*c*, 200*d*) is used as a reference signal, such that one signal serves as a conventional base.

As may be seen from FIG. 28A, if the balancer 100*a* is installed only at the front surface of the rotary tub 30, the position detection sensor 23 outputs signals (M1, M2) respectively generated from two balancing modules (200*a*, 200*b*). The controller 1502 uses any one of two output signals (M1, M2) as a reference signal, such that it recognizes a relative position of the other output signal. For example, as may be seen from FIG. 28A, the controller 1502 uses a pulse generation time point of the output signal M1 as a reference, and measures a time t(m2) extending to the pulse generation time point of the output signal M2. The controller 1502 calculates the time t(m2) on the basis of a rotation angle, such that it may recognize a relative position of the balancing module 200*b* associated with the position of the balancing module 200*a*. In contrast, the controller 1502 uses a pulse generation time point of the output signal M2 as a reference, measures a time t(m1) reaching the pulse generation time point of the output signal M1, and calculates the time t(m1) as a rotation angle, such that it may recognize a relative position of the balancing module 200*a* associated with the balancing module 200*b*. In order to calculate the time interval α' described in FIGS. 19A, 19B and 19C and 20A, 20B and 20C, the output signal generated by the balancing module which has a fixed position without movement is used as a reference, and a time interval reaching the pulse generation time point of the output signal generated by a different balancing module having a changing position by movement may be measured, such that the time interval α' may be calculated. For example, assuming that the balancing module 200*a* is fixed and the other balancing module 200*b* is shifted or moves, the output signal M1 generated by the balancing module 100*a* having a fixed position without movement is used as a reference, and the time interval α' reaching the pulse generation time point of the output signal M2 generated by the other balancing module 100*b* having a changing position by movement may be measured. In contrast, if the balancing module 200*b* is fixed and the other balancing module 200*b* is shifted, the output signal M2 generated by the balancing module 100*b* having a fixed position without movement is used as a reference, and the time interval α' reaching the pulse generation time point of the output signal M2 generated by the other balancing module 100*a* having a changing position by movement may be measured.

Referring to FIG. 28B, if the balancers (100*a*, 100*b*) are installed only at both the front surface and the rear surface of the rotary tub 30, the position detection sensors (23, 25) output signals (M1, M2, M3, M4) respectively generated from four balancing modules (200*a*, 200*b*, 200*c*, 200*d*). The controller 1502 uses any one of four output signals (M1, M2, M3, M4) as a reference signal, such that it recognizes the relative position of the remaining three output signals. However, when the positions of the balancing modules (200*a*, 200*b*) of the front balancer 100*a* are detected, any one of the output signals (M3, M4) generated by the balancing modules (200*c*, 200*d*) of the rear balancer 100*b* is used as a reference. When the positions of the balancing modules (200*c*, 200*d*) of the rear balancer 100*b* are detected, any one of the output signals (M1, M2) generated by the balancing modules (200*a*, 200*b*) of the front balancer 100*a* is used as a reference.

For example, as may be seen from FIG. 28B, the controller 1502 uses a pulse generation time point of the output signal M1 as a reference, measures not only a time t(m3) reaching the pulse generation time point of the output signal M3 but also a time t(m4) reaching the pulse generation time point of the output signal M4. Each of the time t(m3) and the time t(m4) is calculated as a rotation angle, such that the relative position of the balancing modules (200*c*, 200*d*) with respect to the position of the balancing module 200*a* may be recognized. In contrast, the controller 1502 uses the pulse generation time point of the output signal M3 as a reference, and measures not only a time t(m1) reaching the pulse generation time point of the output signal M1 but also a t(m2) reaching the pulse generation time point of the output signal M2. Each of the time t(m1) and the time t(m2) is calculated as a rotation angle, such that the relative position of the balancing modules (200*a*, 200*b*) with respect to the position of the balancing module 200*c* may be recognized. In order to calculate the time interval α' of FIGS. 19A, 19B and 19C and 20A, 20B and 20C, in the same manner as in FIG. 28A, the output signal generated by the balancing module having a fixed position without movement is used as a reference, and a time reaching the pulse generation time point of the output signal generated by a different balancing module having a changing position by movement is measured, such that the time β' may be calculated.

As is apparent from the above description, an embodiment of the present disclosure achieves correct communication between the controller and the balancing modules, such that an objective balancing module to be shifted is correctly shifted to a target position.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A method by a controller of a washing machine which includes a rotary tub accommodating wash water to rotate upon receiving rotational force from a drive source, a balancer mounted to the rotary tub to include a ring-shaped channel in which a plurality of balancing modules, each assigned a module identification (ID), are disposed to attenuate unbalance generated by rotation of the rotary tub, a position detection sensor to detect a position of the plurality of balancing modules, and the controller to send movement commands that include a communication ID to the plurality of balancing modules, the method comprising;

measuring a first time between position detection time points of the balancing modules during rotation of the rotary tub when the plurality of balancing modules are in a static mode which is a fixed position in the channel for each balancing module of the plurality of balancing modules;

measuring a second time between position detection time points of the balancing modules during rotation of the rotary tub when one of the balancing modules among the plurality of balancing modules is shifted by a predetermined distance within the channel through a first movement command of shifting or moving the one of the balancing modules; and confirming a correspondence between a first module ID of the one of the balancing modules and a first communication ID of the first movement command in response to a relative variation of the second time with respect to the first time, such that sending of the first movement command using the first communication ID to the one of the balancing modules attenuates the generated unbalance.

2. The method according to claim 1, wherein:

the relative variation of the second time with respect to the first time is increased or decreased in response to a movement direction of the one of the balancing modules.

3. The method according to claim 1, further comprising:

measuring the second time for at least one other balancing module other than the one of the balancing modules by independently shifting the at least one other balancing module through a subsequent movement command for at least one other communication ID; and confirming a correspondence between at least one other module ID and the at least one other communication ID of the subsequent movement command by comparing the first time with the second time for the at least one other balancing module.

4. The method according to claim 1, further comprising:

measuring the second time for each remaining balancing module by independently shifting each remaining balancing modules other than the one of the balancing modules through a subsequent movement command for each remaining communication ID; and confirming a correspondence between each remaining module ID and the remaining communication ID of the subsequent movement command of the remaining balancing modules other than the one of the balancing modules by comparing the first time with the second time for each remaining balancing module.

* * * * *